US007126569B2

(12) United States Patent
Ootsuka et al.

(10) Patent No.: US 7,126,569 B2
(45) Date of Patent: Oct. 24, 2006

(54) LIQUID CRYSTAL DISPLAY DEVICE

(75) Inventors: Hiroshi Ootsuka, Toyokawa (JP); Kiyofumi Hashimoto, Suita (JP); Shuichiro Kaneko, Yokohama (JP); Katsuhiko Asai, Sakai (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/527,368

(22) Filed: Mar. 16, 2000

(65) Prior Publication Data

US 2003/0103023 A1 Jun. 5, 2003

(30) Foreign Application Priority Data

Mar. 23, 1999 (JP) ..... 11-077457
Mar. 23, 1999 (JP) ..... 11-077458

(51) Int. Cl.
*G09G 3/36* (2006.01)

(52) U.S. Cl. ..... 345/87; 345/96; 345/98; 345/100; 345/103

(58) Field of Classification Search ..... 345/87–104, 345/690, 699, 204–219, 194, 7, 700, 629, 345/7.51, 55, 107, 418, 173; 725/39; 368/204; 323/312; 349/16; 359/291, 296; 704/270
See application file for complete search history.

(56) References Cited

U.S. PATENT DOCUMENTS 3,879,723 A * 4/1975 Hornung ..... 345/51
4,317,115 A * 2/1982 Kawakami et al. ..... 340/784
4,527,906 A * 7/1985 Jezbera ..... 368/107
4,547,309 A 10/1985 Mochizuki et al. .... 252/299.63
4,728,936 A * 3/1988 Guscott et al. ..... 340/525
5,357,267 A 10/1994 Inoue ..... 345/201
5,481,274 A * 1/1996 Aratani et al. ..... 345/98
5,487,276 A * 1/1996 Namisniak et al. ..... 62/125
5,583,534 A * 12/1996 Katakura et al. ..... 345/97
5,587,683 A * 12/1996 Kawasaki et al. ..... 327/538
5,625,477 A * 4/1997 Wu et al. ..... 349/35
5,627,560 A * 5/1997 Verhulst ..... 345/97
5,684,504 A * 11/1997 Verhulst et al. ..... 345/97
5,726,676 A * 3/1998 Callahan, Jr. et al. ..... 345/98
5,740,132 A * 4/1998 Ohshima et al. ..... 368/204
5,796,447 A * 8/1998 Okumura et al. ..... 349/33
5,802,555 A * 9/1998 Shigeeda ..... 711/106
5,822,278 A * 10/1998 Ohshima et al. ..... 368/204
5,926,159 A * 7/1999 Matsuzaki et al. ..... 345/97
5,952,990 A * 9/1999 Inoue et al. ..... 345/97
6,008,787 A * 12/1999 Kondoh ..... 345/97
6,075,508 A * 6/2000 Ono et al. ..... 345/98
6,085,047 A * 7/2000 Taka ..... 396/374
6,166,726 A * 12/2000 Uchida et al. ..... 345/211

(Continued)

FOREIGN PATENT DOCUMENTS

JP 08-03759 * 7/1994

*Primary Examiner*—Bipin Shalwala
*Assistant Examiner*—Prabodh Dharia
(74) *Attorney, Agent, or Firm*—Sidley Austin LLP

(57) ABSTRACT

A liquid crystal display device which has a liquid crystal display which uses liquid crystal with a memory effect. When a contact action with a screen of the liquid crystal display is made, information displayed thereon is written again thereon. Also, if no changes have been made on the information displayed for a whole day, the same information is automatically written on the liquid crystal display. The display device is attachable to and detachable from a household electrical appliance. The information is about at least one of a calendar, a recipe, a massage, stock, a picture and data reception from outside, etc.

20 Claims, 20 Drawing Sheets

U.S. PATENT DOCUMENTS 6,204,902 B1 * 3/2001 Kim et al. ..... 349/112
6,233,027 B1 * 5/2001 Unno et al. ..... 349/25
6,243,063 B1 * 6/2001 Mayhew et al. ..... 345/94
6,268,840 B1 * 7/2001 Huang ..... 345/94
6,323,851 B1 * 11/2001 Nakanishi ..... 345/211
6,329,967 B1 * 12/2001 Little et al. ..... 345/55
6,342,901 B1 * 1/2002 Adler et al. ..... 345/700
6,392,786 B1 * 5/2002 Albert ..... 359/296
6,704,133 B1 * 3/2004 Gates et al. ..... 359/296
6,888,522 B1 * 5/2005 Shibata et al. ..... 345/87
7,019,737 B1 * 3/2006 Asai et al. ..... 345/211
2001/0006389 A1 * 7/2001 Nanba et al. ..... 345/418
2002/0184626 A1 * 12/2002 Darbee et al. ..... 725/39
2003/0132908 A1 * 7/2003 Herb et al. ..... 345/107
2004/0239614 A1 * 12/2004 Amundson et al. ..... 345/107
2006/0020469 A1 * 1/2006 Rast ..... 704/270
2006/0077524 A1 * 4/2006 Palmateer ..... 359/291

* cited by examiner

FIG. 7

STOCK OF FOOD

| ITEM | PRODUCED | NUMBER | EXPIRE |
|---|---|---|---|
| CABBAGE | JUL. 7 | 1 | JUL. 14 |
| MILK | JUL. 7 | 1 | JUL. 10 |
| BEEF | JUL. 7 | 300g | JUL. 10 |
| CARROTS | JUL. 7 | 2 | JUL. 20 |
| CUCUMBERS | JUL. 7 | 5 | JUL. 14 |
| PICKLES | JUN. 30 | 1 | JUL. 10 |
| ICE CREAM | JUN. 10 | 5 | AUG. 31 |

U 202

D 203

DISPLAY SWITCH 201

FIG. 8

RECIPE

CURRY

| | |
|---|---|
| BEEF | 100g |
| POTATOES | 100g |
| ONIONS | 100g |
| WATER | 500cc |
| CURRY POWDER | 200g |
| SALT & PEPPER | AS YOU LIKE |

U 202

D 203

DISPLAY SWITCH 201

LIQUID CRYSTAL DISPLAY DEVICE

This application is based on application Nos. 11-77457 and 11-77458 filed in Japan, the content of which is hereby incorporated by reference.

BACKGROUND OF THE INVENTION

1. Field of the Invention

The present invention relates to a liquid crystal display device for displaying various kinds of information, and more particularly to a liquid crystal display device which has a liquid crystal display with a memory effect.

2. Description of Related Art

Recently, displays which use liquid crystal are widely used. There are various kinds of liquid crystal displays, and as a type of display with a memory effect, a reflective type liquid crystal display which uses ferrodielectric liquid crystal or cholesteric liquid crystal is known. A well-known TN type liquid crystal display repeats writing at intervals of a very short time so as to keep displaying an image thereon, that is, executes a refresh drive. A liquid crystal display with a memory effect, on the other hand, an image written thereon is kept even after stoppage of application of a driving voltage, which is good in energy saving.

However, such a liquid crystal display with a memory effect has a problem that when someone touches the screen while the display keeps an image thereon, the image may be disordered and the disordered image may be kept thereon.

By way of analogy, since a refrigerator has a flat and plain surface, generally, memos and recipes are stuck thereon by magnets or an adhesive tape, or a white board is magnetically fitted onto the surface so that schedules or other information can be written thereon by a marker. In such ways, however, the volume of information to be displayed is limited, and in the case of using a white board, when the written information is erased, rubbish may be dispersed, and the writer may smudge a hand. Also, in these cases, what are written and displayed are only letters and schemes, and it is difficult to write accurate images.

Japanese Patent Laid Open Publication Nos. 9-19768 and 8-35759 disclosed that a liquid crystal display is provided on the surface of a refrigerator. The displays suggested by these documents are of a type which uses liquid crystal without a memory effect and consumes electric power to keep displaying an image thereon. Refrigerators consume great electric power compared with other household electrical appliances, and to reduce the consumption of electric power of refrigerators is a big task in view of energy saving. Providing a liquid crystal display without a memory effect to a refrigerator results in an increase in the consumption of electric power of the refrigerator, which is against the demand of the times. Even if such a liquid crystal display without a memory effect is used, by using a timer to shut off supply of electric power to the display after a specified time, energy saving can be achieved. In this case, however, the image on the display will be erased simultaneously with the shut-off of supply of electric power.

SUMMARY OF THE INVENTION

An object of the present invention is to provide a liquid crystal display device with a memory effect which achieves energy saving and displays an image in good condition while not being supplied with electric power.

In order to attain the object, a liquid crystal display device according to the present invention comprises: a display section which uses liquid crystal with a memory effect; a driving section which drives the display section; and a control section which controls the driving section to write currently displayed information on the display section again at a specified time.

The control circuit, for example, executes a rewriting process, at a specified time, to write on the display section in accordance with image data which correspond to the information currently displayed on the display section. The specified time means, for example, when a contact action with a screen of the display section is made. If a touch sensor is provided on the screen of the display section so that the user can command a specified control by touching a specified area of the touch sensor, this touching action may cause disorder of the image displayed on the display section. By executing the rewriting process, the image can be restored. The rewriting process may be executed repeatedly at uniform intervals of a predetermined time. For example, if no changes have been made on information displayed on the display section for a whole day, someone may touch the display section without intention during the time, and the image on the display section may be deformed. In this case, by executing the rewriting process automatically, the image can be restored. The rewriting process may also be executed after writing on part of the display section.

Since the display device according to the present invention uses liquid crystal with a memory effect, electric power is necessary only when writing is performed, that is, no electric power is necessary to keep displaying the written image. Thus, this display device is energy saving. It is preferred to use chiral nematic liquid crystal which exhibits a cholesteric phase as the liquid crystal with a memory effect. By use of this liquid crystal, a relatively large-screen display can be produced at low cost.

The liquid crystal display device according to the present invention can be used as a sub display of an electronic information device such as a personal computer or as an information display device attached to a household electrical appliance such as a refrigerator. When the display device is attached to a household electrical appliance, the display device is supplied with electric power from the electrical appliance. Since the display device has a memory effect, the display device keeps displaying information thereon even after being detached from the electrical appliance and can be moved to any other place.

On the display device, various kinds of information, such as a calendar, a message, stock, a picture, data reception from outside, etc. can be displayed. These are switched one from another to be displayed. A touch sensor and a pen-type input device may be provided.

Also, by providing a control section which supplies electric power to the driving circuit of the liquid crystal display to write information thereon and stops the supply of electric power to the driving circuit after writing, the energy saving effect of the display device becomes stronger. The liquid crystal display may be driven by a secondary battery which is charged with electricity supplied from an electric power source of the household electrical appliance to which the display device is attached.

BRIEF DESCRIPTION OF THE DRAWINGS

These and other objects and features of the present invention will be apparent from the following description with reference to the accompanying drawings, in which:

FIG. 7 is an illustration which shows a way of displaying the stock of food in the refrigerator;

FIG. 8 is an illustration which shows a way of displaying a recipe;

DETAILED DESCRIPTION OF THE PREFERRED EMBODIMENTS

Liquid crystal display devices according to the present invention are described with reference to the accompanying drawings.

General Structure of Refrigerator

Figure 1:
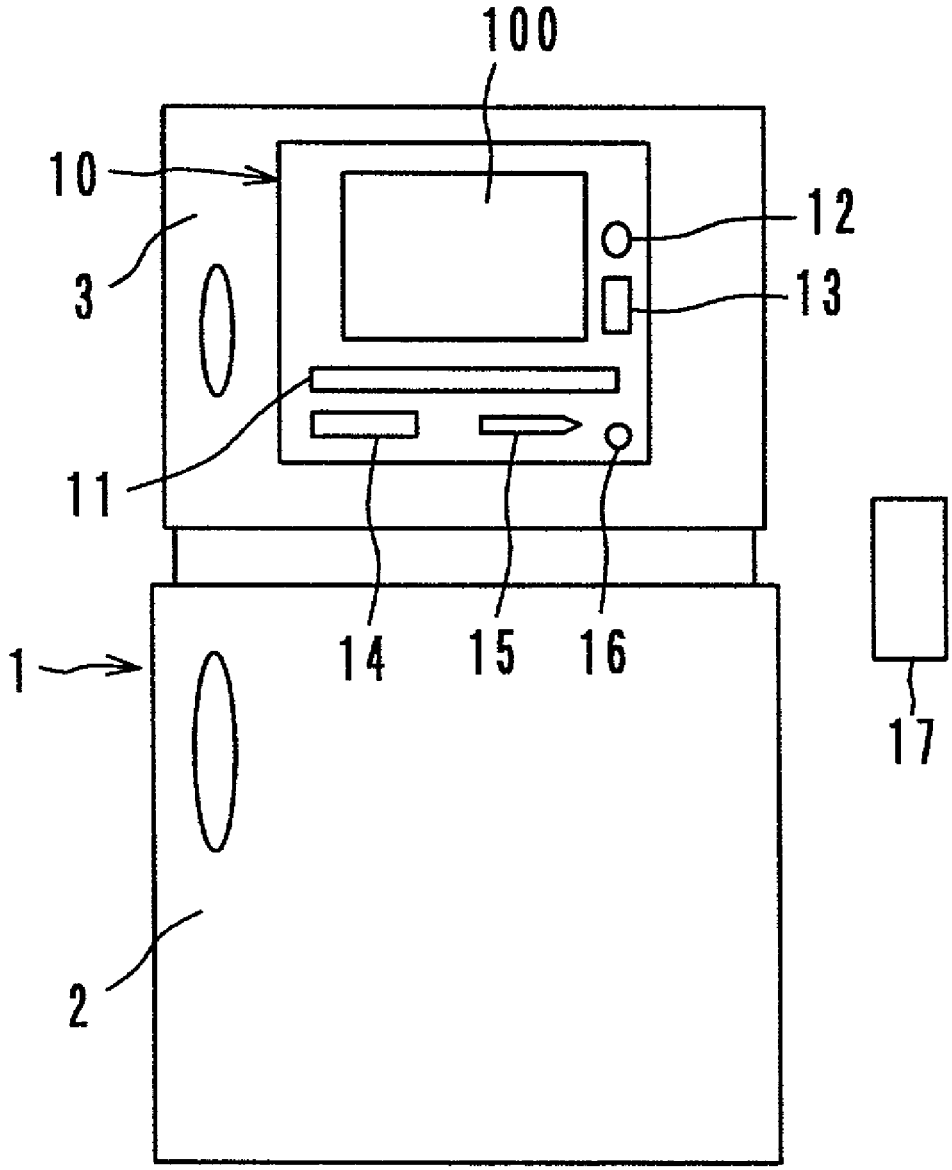
FIG. 1 is a front view of a refrigerator with a liquid crystal display device which is an embodiment of the present invention.
Figure 2:
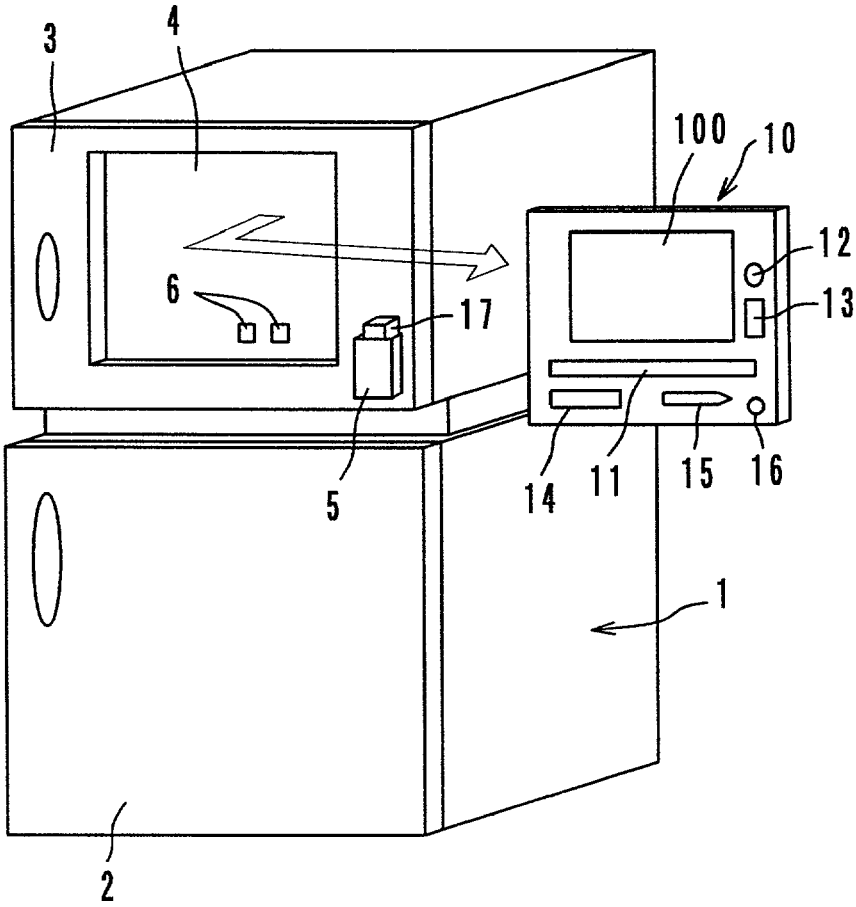
FIG. 2 is a perspective view of the refrigerator, showing a state where the liquid crystal display device is detached therefrom.

FIGS. 1 and 2 show a refrigerator body 1 composed of an upper chamber and a lower chamber. The numeral 2 is a lower door, and the numeral 3 is an upper door. The numeral 10 denotes a liquid crystal display device 10, and the display device 10 is fitted in a recess 4 of the upper door 3. The liquid crystal display device 10 has a full-color liquid crystal display 100, which will be described in detail later. The display device 10 further comprises a front light 11, a light sensor 12, a data receiving section 13, a card slot 14, a pen 15 and a rewrite switch 16 to command a rewriting process to write the currently displayed image again. Moreover, a bar code reader 17 is provided so as to read bar codes provided on packages of food and to transmit the read data as radio wave data. This bar code reader 17 with a transmitter, as FIG. 2 shows, is encased in a holder 5 fitted on the upper door 3. The pen 15 is attachable to and detachable from the display device 10.

Figure 3:
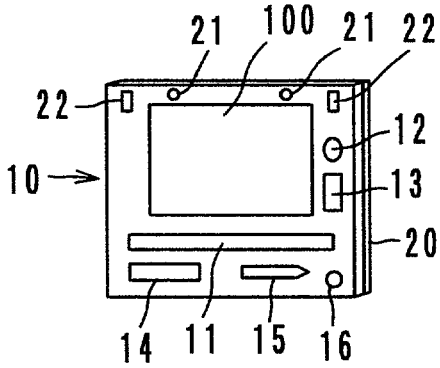
FIG. 3 is a perspective view of a modified liquid crystal display device.

The liquid crystal display device 10 is structured to be very thin and fitted in the recess 4 of the upper door 3. It is possible to stick the display device 10 on the surface of the upper door 3 without forming the recess 4. Also, the display device 10 may be fixed completely or may be fitted in such a way to be detachable from the upper door 3. In order to fit the display device 10 in such a way to be detachable from the upper door 3, for example, as FIG. 3 shows, a magnet 20 may be provided on the reverse side of the display device 10, or holes 21 may be formed in the display device 10 so that the display device 10 can be hanged from a bar (not shown) provided on the upper door 3. In such a case, if handles 22 are provided on the display device 10, it would be convenient in attaching and detaching the display device 10 to and from the door 3. If the liquid crystal display device 10 is so structured as to be detachable from the refrigerator body 1, the display device 10 can be used alone as a bulletin board, an ornamental framed picture or a viewer of various information, and also, repair and exchange of the display device 10 will be easy.

As the driving source of the liquid crystal display device 10, a secondary battery is provided. For electric charge on the secondary battery, a power source section of the refrigerator body 1 is used, and a contact point 6 (see FIG. 2) with a charging control circuit is provided in the recess 4. The secondary battery is charged with electricity by putting its electrode in contact with the contact point 6.

The liquid crystal display device 10 displays various kinds of information, and typically, calendar, recipes, messages, stock in the refrigerator, ornamental images, data reception from a communication line, etc. are displayed. Recipes and ornamental images are stored in exclusive memory cards. When such a memory card is inserted in the slot 14, data in the memory card are automatically read out and displayed. In other words, the slot 14 and a memory card inserted therein also function as a display selection switch.

Power Source/Control Circuit

Figure 4:
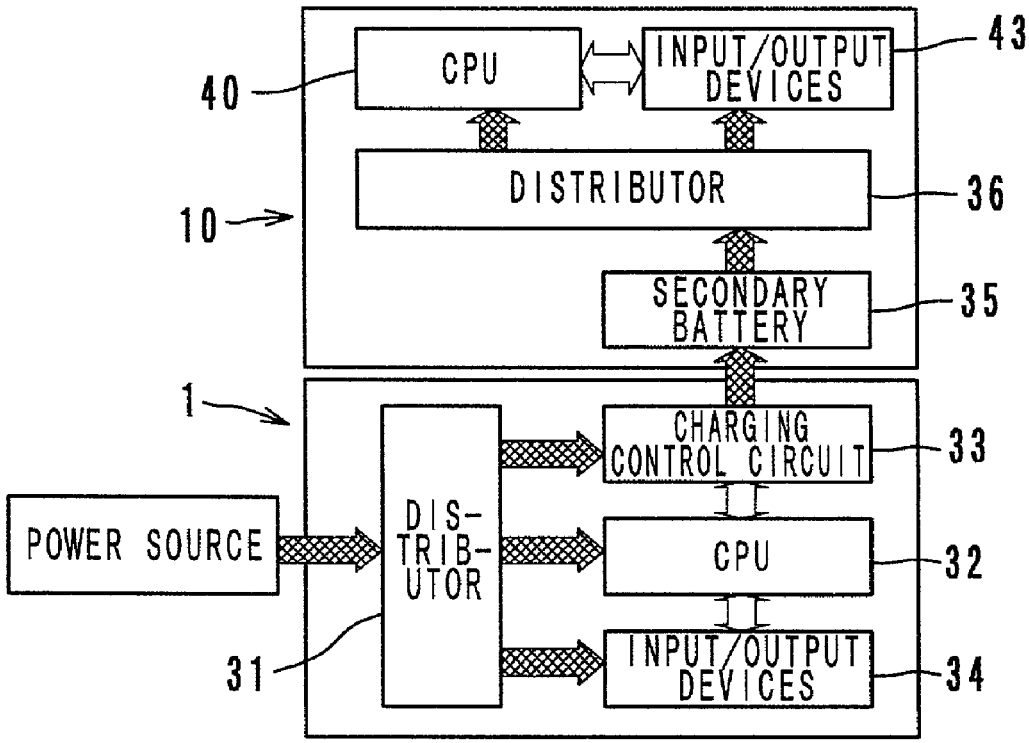
FIG. 4 is a block diagram which shows a first exemplary power source/control circuit.

FIG. 4 shows power source/control circuits of the refrigerator body 1 and the liquid crystal display device 10. The circuit for the refrigerator body 1 incorporates a distributor 31 connected to an outlet of electric power (50 Hz or 60 Hz). The distributor 31 distributes electric power to a CPU 32, a charging control circuit 33, input/output devices 34 such as a compressor, etc. The CPU 32 exchanges signals with the charging control circuit 33 and the input/output devices 34.

The circuit for the liquid crystal display device 10 incorporates a secondary battery 35 which is charged with electric power controlled by the charging control circuit 33 and a distributor 36. The distributor 36 distributes electric power to a CPU 40 and input/output devices 43. The CPU 40 exchanges signals with the input/output devices 43.

Figure 5:
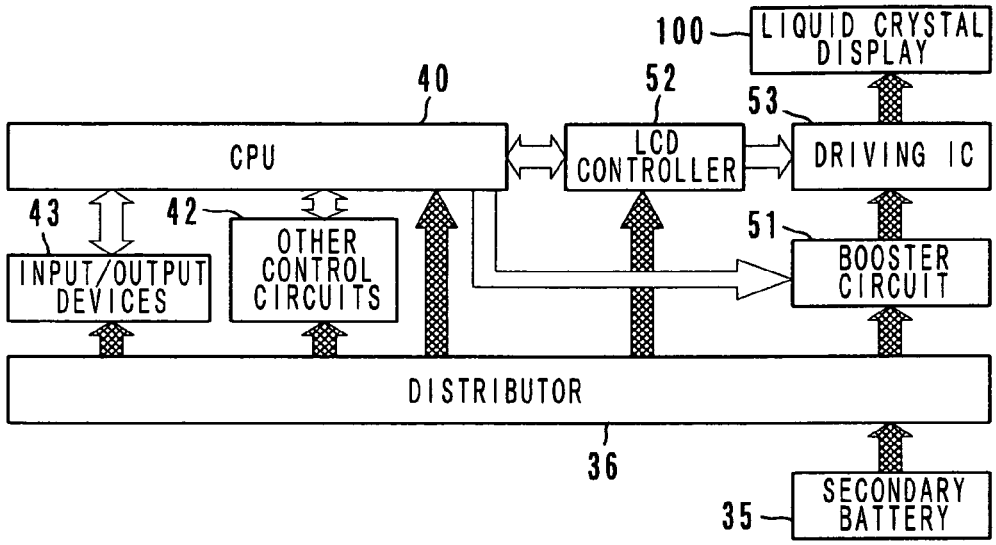
FIG. 5 is a block diagram which shows the power source/control circuit in more detail.

FIG. 5 shows the circuit for the liquid crystal display 10 in more detail. The distributor 36 distributes electric power further to an LCD controller 52, other control circuits 42 and a booster circuit 51. The booster circuit 51 supplies electric power according to a specification to a driving IC 53. The LCD controller 52 operates the driving IC 53 in cooperation with the CPU 40 to drive the liquid crystal display 100.

The CPU 40 starts working when the battery 35 is fitted in the device 10 or when the battery 35 is charged sufficiently. The booster circuit 51 is capable of being turned on and off by order of the CPU 40, and while the booster circuit 51 is off, the consumption of electric power is greatly reduced.

Figure 6:
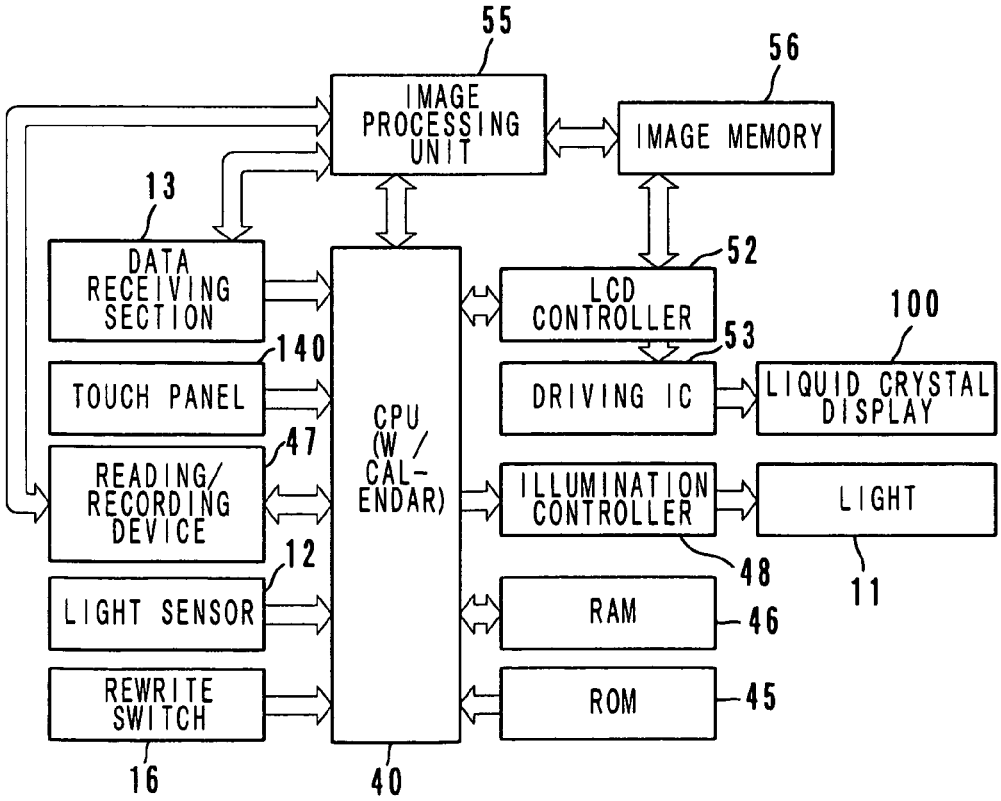
FIG. 6 is a block diagram which shows a second exemplary control circuit.

As FIG. 6 shows, the CPU 40 has a ROM 45 which stores various programs and data and a non-volatile RAM 46 that stores various kinds of data including data to be displayed. To the CPU 40, signals from the light sensor 12 and the rewrite switch 16 are inputted, and further, a signal from a data transmission device provided in the refrigerator body 1 and a signal from the bar code reader 17 are inputted via the data receiving section 13. Furthermore, a signal from a touch panel 140 provided on the liquid crystal display 100 is inputted to the CPU 40. The CPU 40 also has a calendar inside, and exchanges signals with a reading/recording device 47 which performs data reading/recording from and to a card inserted in the slot 14, an image processing unit 55 and an image memory 56. The image processing unit 55 performs necessary image processing to image data sent from the data receiving section 13 and the reading/recording device 47 and transmits the processed data to the image memory 56. Data inputted on the touch panel 140 are transmitted to the image memory 56 as image data. In accordance with the data stored in the image memory 56, the LCD controller 52 controls the driving IC 53 so as to apply voltages to scan electrodes and data electrodes of the liquid crystal display 100 in order, and thus, an image is written on the liquid crystal display 100. The image data stored in the image memory 56 are read out via the image processing unit 55, are subjected to necessary image processing and are transmitted to the reading/recording device 47. Further, the CPU 40 controls the light 11 via an illumination controller 48.

To the refrigerator body 1, a weather forecast, traffic information, event information, circular information, advertisements, e-mail reception, etc. are transmitted via a communication (telephone) line. Such information is inputted to the data receiving section 13 by use of an IrDA or the like to be displayed on the display device 10. Thus, the refrigerator can be used as an information sending base at home. The liquid crystal display device 10 is capable of keeping an image thereon without consuming electric power unless writing on the display 100 is required, and accordingly, the display device 10 does not increase the consumption of electric power of the refrigerator. On the other hand, whenever writing on the display 100 is required, the driving circuit of the liquid crystal display device 10 can be supplied with electric power immediately from the refrigerator body 1 connected to an outlet of electric power.

In this embodiment, the power source/control circuit for the refrigerator body 1 and for the liquid crystal display device 10 are separately structured. However, it is possible to incorporate the liquid crystal display device 10 in the refrigerator body 1 and to integrate both circuits.

Exemplary Ways of Displaying

Next, exemplary ways of displaying information on the liquid crystal display 100 are described. Various ways of displaying can be adopted as well as the following examples shown by FIGS. 7 through 10.

FIG. 7 shows an example of displaying information about the stock of food in the refrigerator 1. The bar codes provided on the packages of food were read by the bar code reader 17, and the data were transmitted to the CPU 40. These data are displayed as a list shown by FIG. 7. On the right side of the list, a display switch key 201 for switching the display mode to others (see FIGS. 8, 9 and 10), scroll keys 202 and 203 are displayed on the touch panel 140. Also, it is possible to select a desired item from the list to change the information about the item by touching the area within the frame of the item.

FIG. 8 shows an example of displaying a recipe. In this case, the keys 202 and 203 are used as an up key and a down key to switch the menu to the previous page or to the next page.

Figure 9:
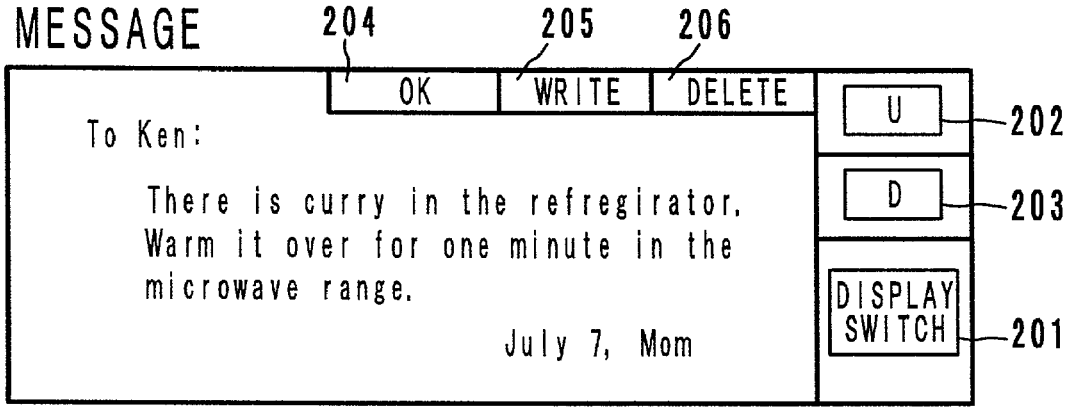
FIG. 9 is an illustration which shows a way of displaying a message.

FIG. 9 shows an example of displaying a message. The letters and drawings were written on the touch panel 140 by use of the pen 15. In the upper part of the screen, keys 204, 205 and 206 are displayed. The OK key 204 is to store these letters and drawings in a memory card. The key 205 is to write new information, and the key 206 is to delete information.

Figure 10:
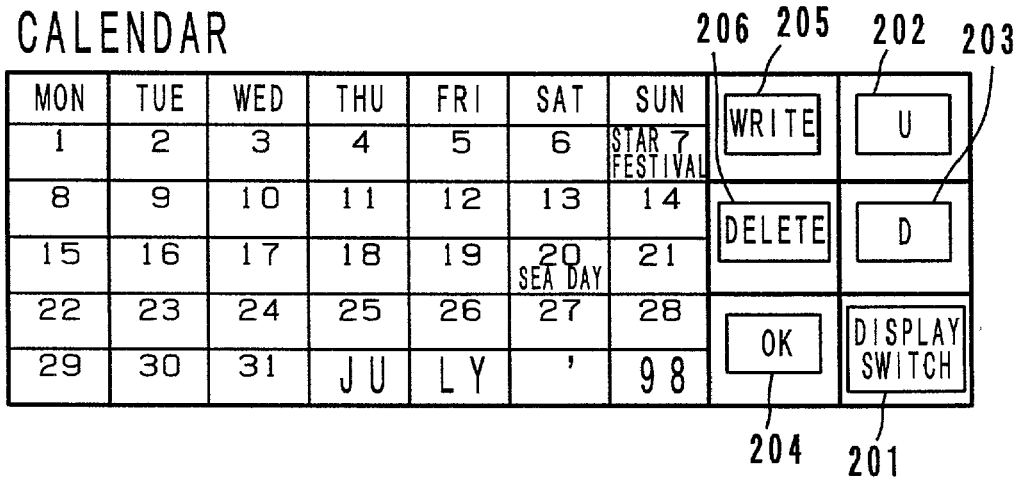
FIG. 10 is an illustration which shows a way of displaying a calendar.

FIG. 10 is an example of displaying a calendar. The keys 201 through 206 function in the same ways as described above. It is possible to designate a date by touching the area within the frame of the date so as to write or erase information in the frame.

Control Procedure

Next referring to FIGS. 11 through 23, a control procedure of the CPU 40 over the liquid crystal display 100 is described.

Figure 11:
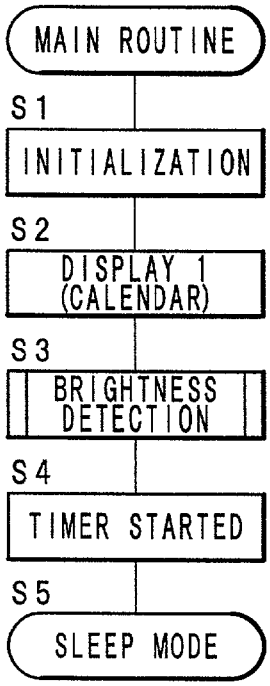
FIG. 11 is a flowchart which shows a main routine for control of the liquid crystal display device.

FIG. 11 shows a main routine. When the battery 35 is fitted in the liquid crystal display device 10, or when the battery 35 is charged sufficiently, the CPU 40 starts and initializes the internal RAM, registers, timers, etc. at step S1. Then, a display 1 (calendar) is made at step S2, and the brightness is detected at step S3. Thereafter, the CPU 40 starts an energy saving timer at step S4 and comes to a sleep mode (energy saving mode) at step S5.

In the sleep mode, the CPU 40 stops supplying an internal clock to all the memories, registers and counters except the minimum necessary ones. Accordingly, the supply of electric power to the input/output devices is stopped, which reduces the consumption of electric power. When the CPU 40 receives an interruption signal in the state of the sleep mode, the CPU 40 comes to an active mode immediately to carry out necessary processing. The energy saving timer continues counting even while the CPU 40 is in the sleep mode.

Figure 12:
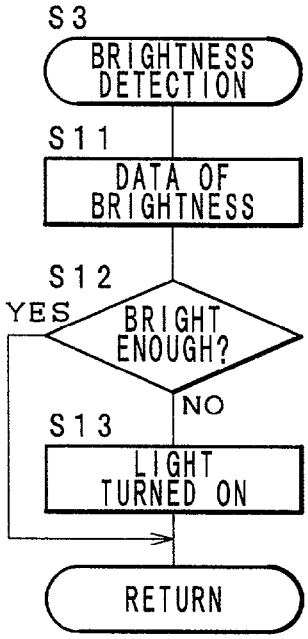
FIG. 12 is a flowchart which shows a brightness detecting subroutine.

FIG. 12 shows a subroutine for detection of the brightness carried out at step S3. At step S11, data about the brightness around the liquid crystal display 100 are inputted from the sensor 12. At step S12, it is judged from the data whether or not the screen of the liquid crystal display 100 is bright enough (to be seen by a person's eye). If it is bright enough, the program returns, and if not, the light 11 is turned on at step S13.

Figure 13:
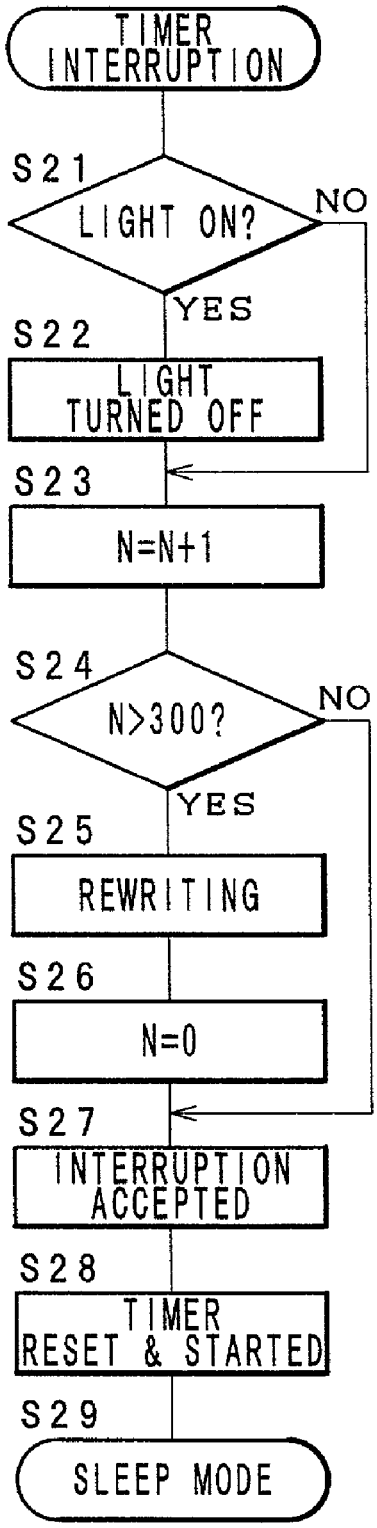
FIG. 13 is a flowchart which shows a timer interruption subroutine.

FIG. 13 shows a timer interruption subroutine. This subroutine automatically starts when the energy saving timer has counted up a specified time (for example, five minutes). First at step S21, it is judged whether or not the light 11 is lit. If the light 11 is lit, the light 11 is turned off at step S22. Next at step S23, one is added to a variable N, and until the variable N becomes equal to 300, any interruption is accepted at step S27. Then, the CPU 40 resets the energy saving timer at step S28 and comes to the sleep mode at step S29.

If the count-up time of the energy saving timer is five minutes, it takes almost one whole day until the variable N becomes equal to 300. When the variable N becomes equal to 300, which means one day has passed without any commands to make a change on the liquid crystal display 100, the currently displayed image is written again at step S25, and the variable N is reset to 0 at step S26. There is a possibility that someone may touch the liquid crystal display 100 which may degrade the image thereon. In order to restore the image automatically, this process is carried out.

Figure 14:
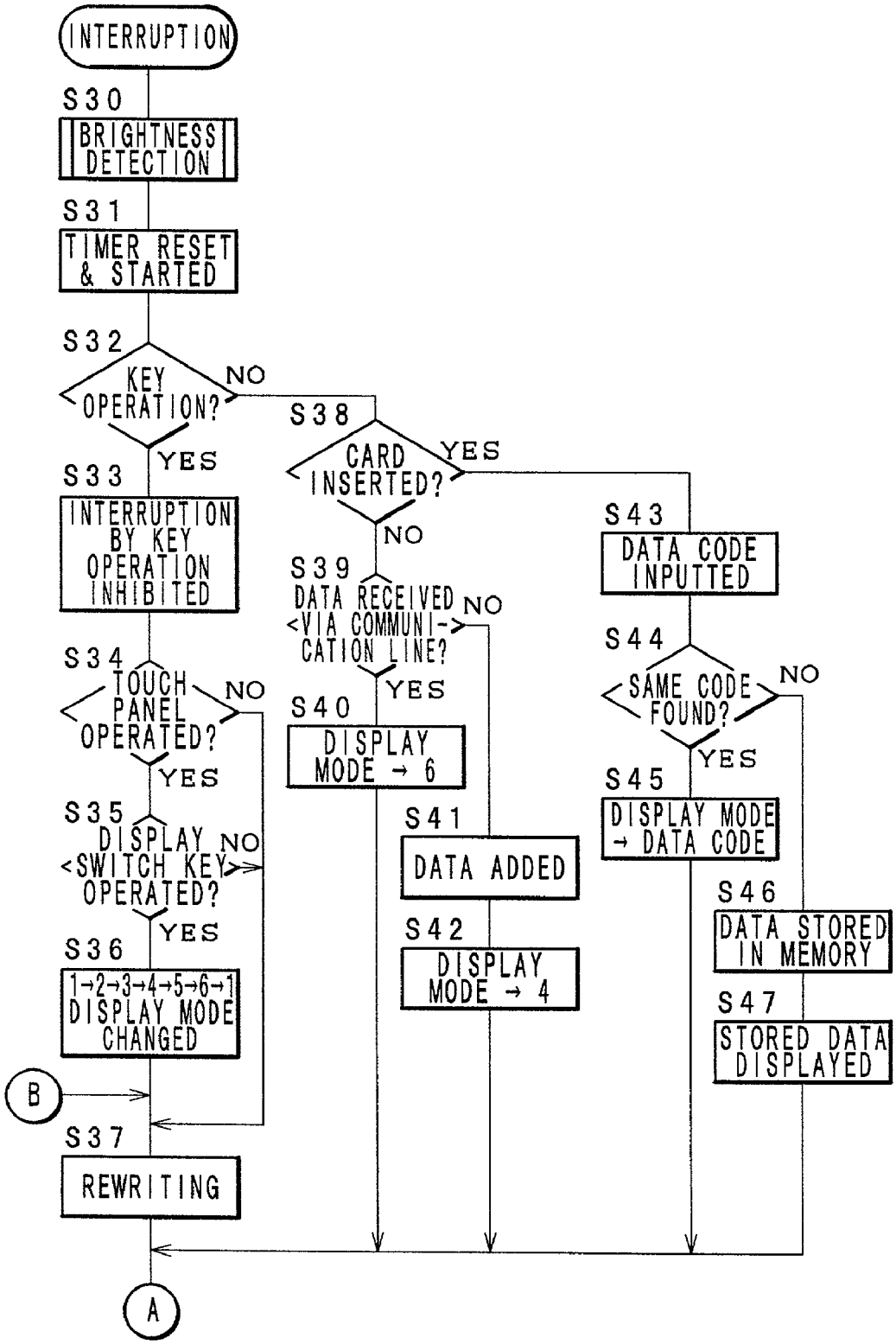
FIGS. 14 and 15 are flowcharts which show an interruption subroutine.
Figure 15:
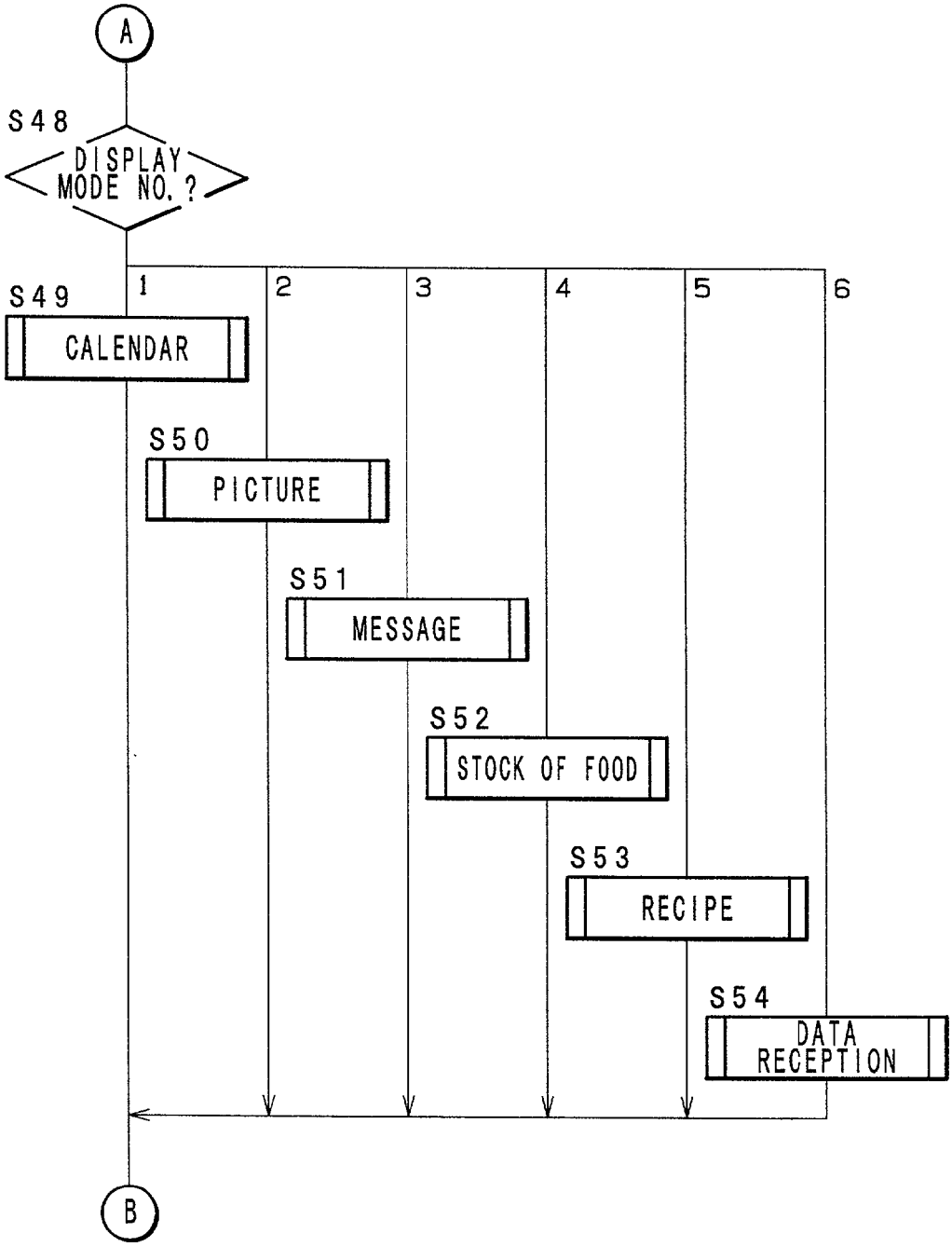

FIGS. 14 and 15 show an interruption subroutine. This subroutine is carried out by the CPU 40 which has become active in response to an operation on the touch panel 140, a data input from the bar code reader 17 via the IrDA or an insertion of a memory card in the slot 14.

First at step S30, the brightness is detected in the same way as described referring to FIG. 12. Thereby, when an operation on the touch panel 140, a data input from the bar code reader 17 via the IrDA or an insertion of a memory card in the slot 14 has been made, if the surroundings are dark, the light 11 is turned on. Thereafter, in order not to accept an interruption by the energy saving timer while the user is operating the screen, the CPU 40 resets and starts the energy saving timer at step S31. It is judged at step S32 whether or not any key operation of the liquid crystal display device 10 has been made. If a key operation has been made, an interruption made by this key operation is inhibited at step S33. Next at step S34, it is judged whether the key operation was made on the touch panel 140, and if so, the program goes to step S35. If not, it is judged that the key operation was made with the rewrite switch 16, and the program goes to step S37 for rewriting, which will be described in detail later. At step S35, it is judged whether the key operation was made with the display switch key 201. If so, the display mode is changed cyclicly in a specified order, and rewriting is performed at step S37. The display mode is changed to 1) calendar, 2) picture, 3) message, 4) stock of food, 5) recipe and 6) data reception cyclicly in this order (see steps 49 through 54).

When the energy saving timer which has been started at step S31 counts up, the timer interruption subroutine shown in FIG. 13 is executed. Thereby, the CPU 40 comes to the sleep mode, and the supply of electric power to the input/output devices including the light 11 is stopped. The energy saving timer is also started at step S64, which will be described later, and other steps for the same purpose.

When part of the liquid crystal screen is touched for a key operation, the image displayed on the screen may be deformed. In order to correct the deformation, the rewriting at step S37 is performed. Generally, on liquid crystal without a memory effect, such as TN liquid crystal, writing is repeated at regular intervals of a short time, and in this case, it is not necessary to perform this rewriting. On the other hand, chiral nematic liquid crystal used in the present invention has a memory effect, and an image displayed thereon can be kept even after stoppage of supply of electric power to the liquid crystal. Accordingly, writing on the liquid crystal is not required at intervals of a short time, and writing or rewriting on the display is performed only when necessary. More specifically, to perform rewriting at step S37, the booster circuit 51 is turned on, and after rewriting, the supply of electric power to the booster circuit 51 is stopped. Rewriting at step S65 and other steps is performed in the same way.

Next at step S48, the mode number to be displayed is confirmed, and in accordance with the mode numbers 1 through 6, a display is made at one of the steps S49 through S54. Specifically, a display of calendar of the mode number 1 is made at step S49; a display of a picture of the mode number 2 is made at step S50; a display of a message of the mode number 3 is made at step S51; a display of information about the stock of food of the mode number 4 is made at step S52; a display of a recipe of the mode number 5 is made at step S53; and a display of information about data reception of the mode number 6 is made at step S54. The detailed descriptions of these modes will be given later.

When any key operation has not been made ("NO" at step S32), it is judged at step S38 whether a memory card has been inserted in the slot 14. If a memory card has been inserted, at step S43, a data code indicating the type of the card is inputted from the reading/recording device 47. Then, it is judged at step S44 whether the data code has been stored in the RAM 46, and if the same data code is in the RAM 46, the display mode number is set to this data code at step S45. In this case, the memory card is a card for pictures or for recipes, and in accordance with the display mode number, a display is made at one of the steps S49 through S53.

If the same data code is not in the RAM 46 ("NO" at step S44), the content of the memory card is inputted and stored in the image memory 56 at step S46 and is displayed on the liquid crystal display 100 at step S47.

When a memory card has not been inserted ("NO" at step S38), it is judged that the data receiving section 13 has received data. Then, if the data are judged to be from the communication line at step S39, the display mode number is set to 6. If not, it is judged that the data are judged to be received from the bar code reader 17, and the data (about the name of food, the number or weight, the date of production, the date of expiration, etc.) are added at step S41. Then, the display mode number is set to 4 at step S42.

Figure 16:
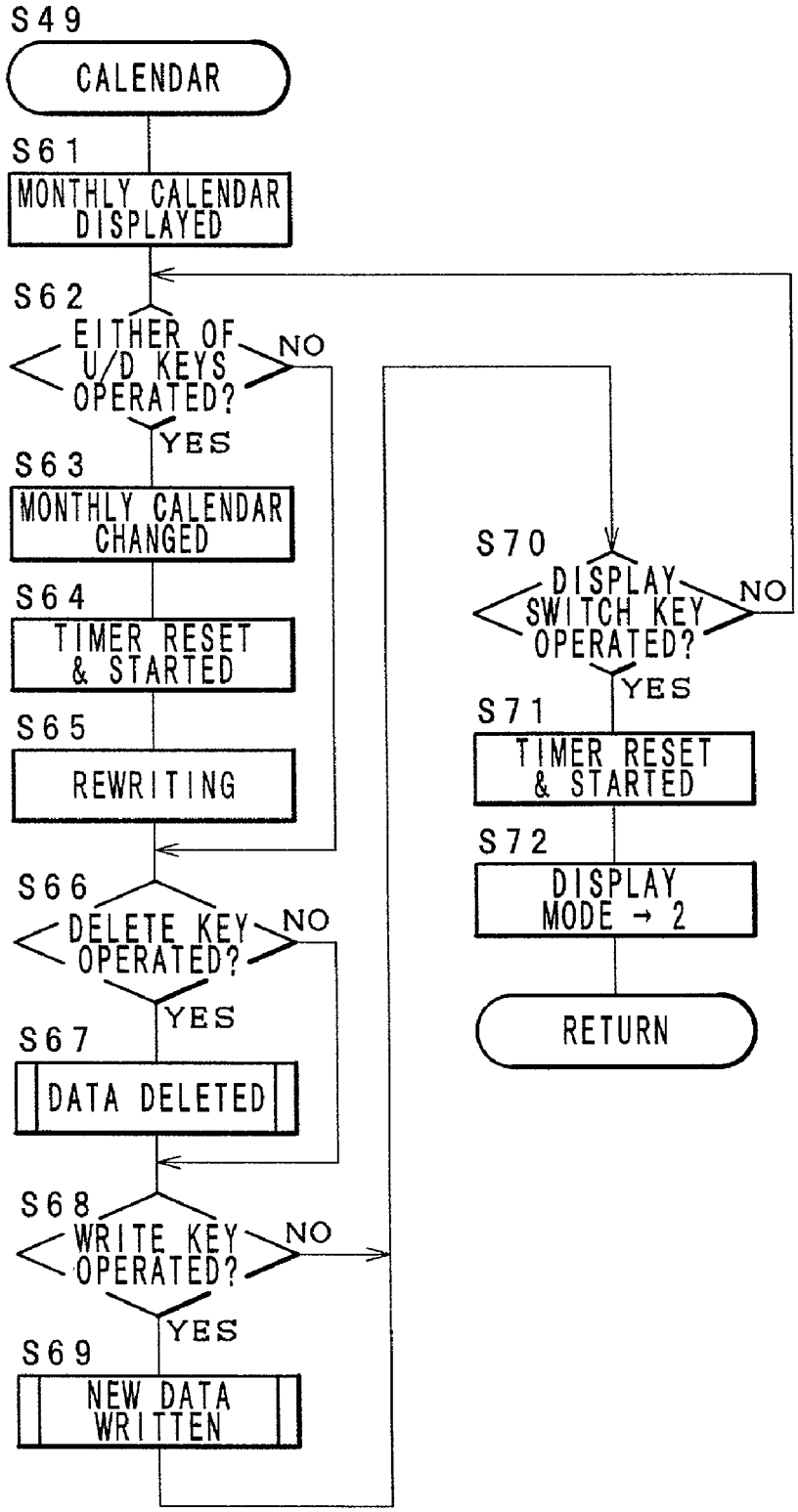
FIG. 16 is a flowchart which shows a calendar displaying subroutine.

FIGS. 16 and 17 show a calendar display subroutine executed at step S49. In the calendar displayed on the screen, as FIG. 10 shows, not only the switch key 201 and the UP/DOWN keys 202 and 203 but also the OK key 204, the write key 205 and the delete key 206 are displayed.

First, a monthly calendar is displayed at step S61, and it is judged at step S62 whether or not either of the keys 202 and 203 has been operated. If an operation with either of the keys 202 and 203 has been made, the previous month or the next month is displayed at step S63, and the energy saving timer is reset and started at step S64. Then, rewriting on the whole screen is performed at step S65.

Next, when it is judged at step S66 that the delete key 206 has been operated, the data stored in the image memory 56 and the information displayed on the screen are deleted at step S67. When it is judged at step S68 that the write key 205 is operated, writing of new information is performed at step S69. Processes at these steps S68 and S69 will be described referring to FIGS. 17A and 17B.

Next, it is judged at step S70 whether or not the display switch key 201 has been operated. If not, the program goes back to step S62. If the key 201 is operated, the energy saving timer is reset and started at step S71, and the display mode number is changed to 2 at step S72. Then, this subroutine is completed.

Figure 17A:
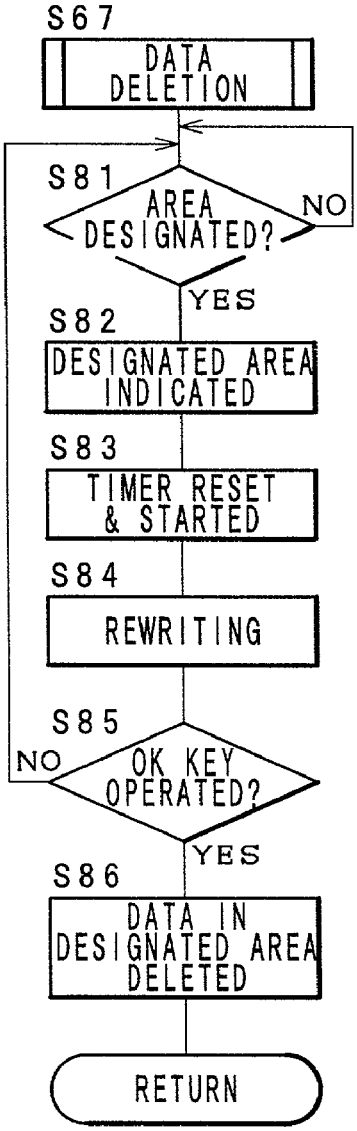
FIG. 17A is a flowchart which shows a data deleting subroutine executed in the calendar display process.

FIG. 17A shows the data deleting process performed at step S67. First at step S81, designation of a date by use of the pen 15 is waited. When the designation is made, at step S82, only the scan lines extending in the area within the frame of the designated date are driven to bold the frame of the date. Then, the energy saving timer is reset and started at step S83, and the same image is written again on the whole screen at step S84. By performing rewriting on the whole screen after performing writing on part of the screen in this way, a problem that a newly written part may be slightly different in tones from the rest can be avoided. Then, when it is judged at step S85 that the OK key 204 has been operated, the image and the data of the designated part are deleted from the screen and from the image memory 56 at step S86.

Figure 17B:
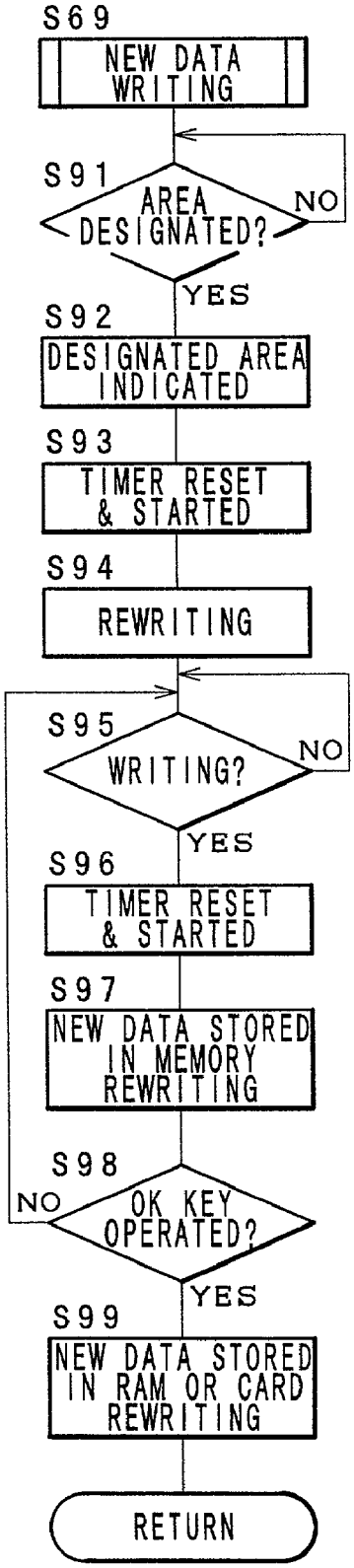
FIG. 17B is a flowchart which shows a new data writing subroutine executed in the calendar display process.

FIG. 17B shows the new information writing process performed at step S69. First at step S91, designation of a date by use of the pen 15 is waited. When the designation is made, at step S92, only the scan lines extending in the area within the frame of the designated date are driven to bold the frame of the date. Then, the energy saving timer is reset and started at step S93, and the same image is written again on the whole screen at step S94.

Further, at step S95, the CPU 40 waits until the user writes any letter by use of the pen 15. When writing is recognized, the energy saving timer is reset and started at step S96, and at step S97, data of the written information are stored in the image memory 56, and in accordance with the data stored in the image memory 56, writing on the whole screen is performed. Then, when it is judged at step S98 that the OK key 204 has been operated, at step S99, the data of the newly written information are stored in a specified area of the RAM 46, or if a memory card is inserted, the data are stored in the memory card. Then, rewriting on the whole screen is performed.

Figure 18:
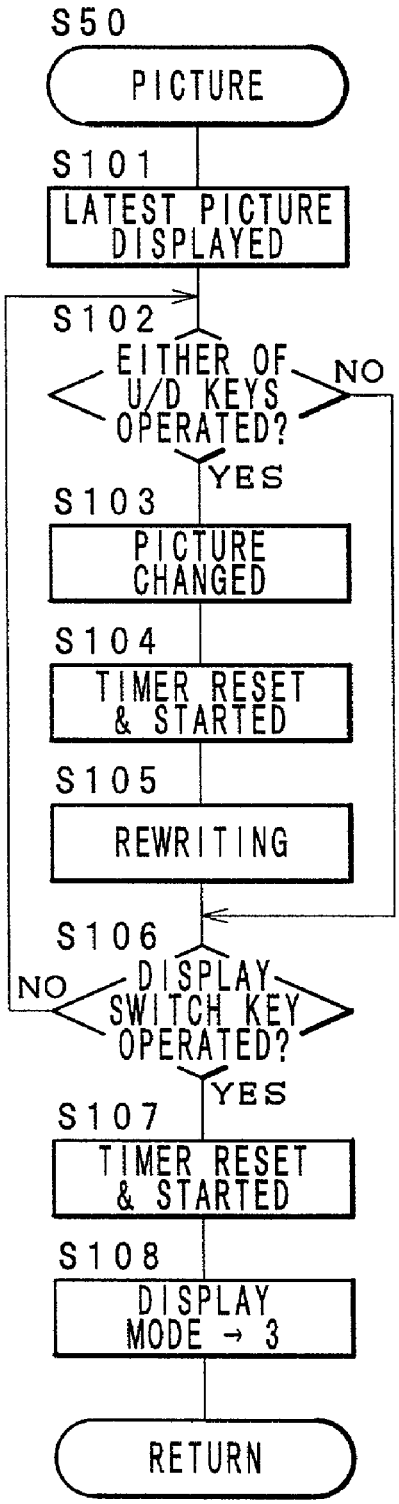
FIG. 18 is a flowchart which shows a picture displaying subroutine.

FIG. 18 shows a picture displaying subroutine executed at step S50. First at step S101, the previously displayed image, such as a picture or a photo, is displayed at step S101. Next at step S102 it is judged whether or not any operation on the UP/DOWN keys 202 and 203 has been made. When either of the keys 202 and 203 has been operated, at step S103, an image is designated in accordance with the key operation from the images stored in the RAM 46 or in a memory card. Then, the energy saving timer is reset and started at step S104, and the designated image is written again on the whole screen at step S105.

Next, it is judged at step S106 whether or not the display switch key 201 has been operated. If not, the program goes back to step S102. If the key 201 has been operated, the energy saving timer is reset and started at step S107, and the display mode number is changed to 3 at step S108. Then, this subroutine is completed.

In a case of displaying a picture, the keys may be displayed in small sizes so as not to interrupt the picture. Also, it is possible to display the keys by operating the touch panel 140.

Figure 19:
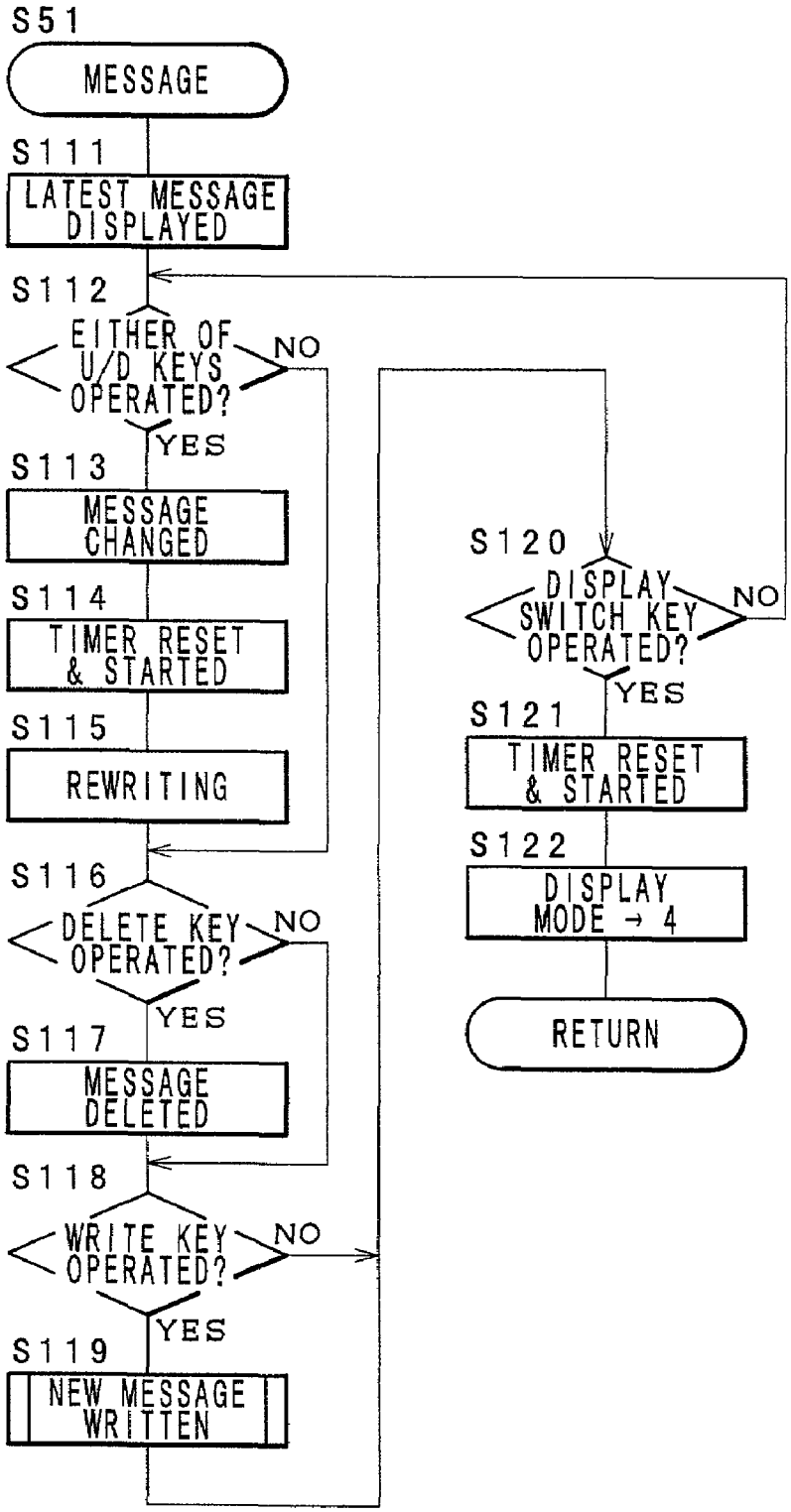
FIG. 19 is a flowchart which shows a message displaying subroutine.
Figure 20:
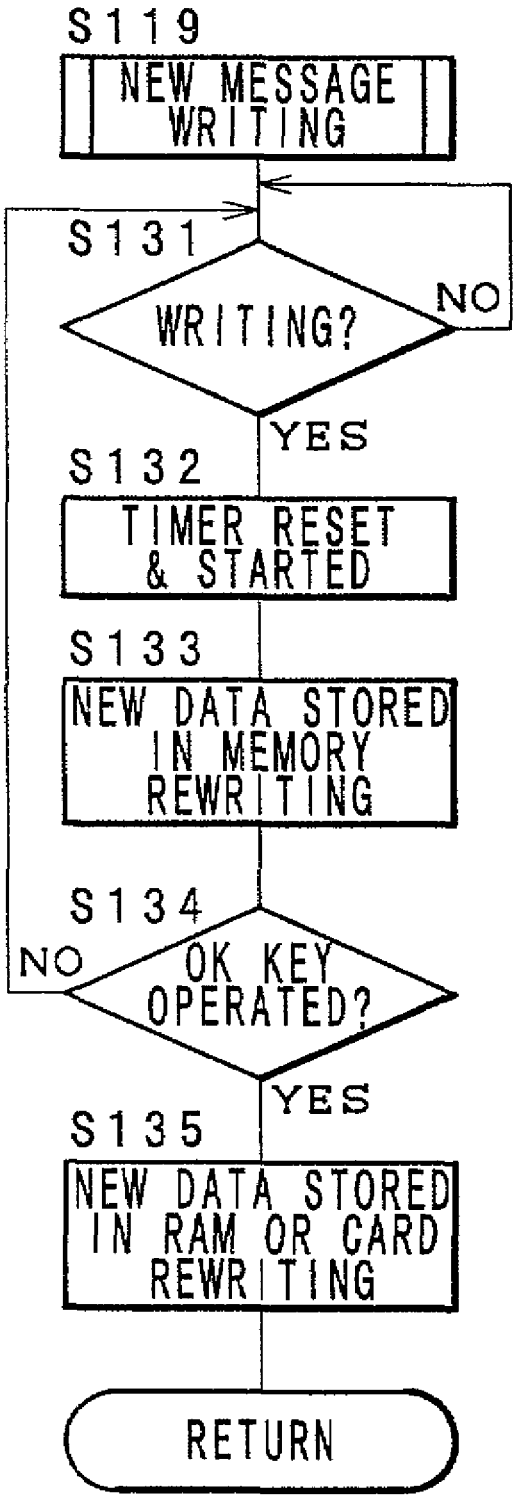
FIG. 20 is a flowchart which shows a new data writing subroutine executed in the message display process.

FIGS. 19 and 20 show a message displaying subroutine executed at step S51. In this display mode, as FIG. 9 shows, the display switch key 201, the UP/DOWN keys 202 and 203, the OK key 204, the write key 205 and the delete 206 are displayed.

First at step S111, the previously displayed message is displayed. Next at step S112, it is judged whether or not any operation on the UP/DOWN keys 202 and 203 has been made. If either of the keys 202 and 203 has been operated, a message is designated in accordance with the key operation from the messages stored in the RAM 46 or in a memory card at step S113. Then, the energy saving timer is reset and started at step S114, and the designated message is written again on the whole screen at step S115.

Next, when it is judged at step S116 that the delete key 206 has been operated, the data and the message are deleted from the memory and from the screen at step S117. When it is judged at step S118 that the write key 205 has been operated, a new message is written at step S119. This new message writing process will be described referring to FIG. 20.

Next, it is judged at step S120 whether or not the display switch key 201 has been operated. If not, the program goes back to step S112. If the key 201 has been operated, the energy saving timer is reset and started at step S121, and the display mode number is changed to 4. Then, this subroutine is completed.

FIG. 20 shows the new message writing process performed at step S119. First at step S131, the CPU 40 waits until the user writes any letter by use of the pen 15. When writing is recognized, the energy saving timer is reset and started at step S132, and at step S133, the written data are stored in the image memory 56, and in accordance with the data in the image memory 56, writing on the whole screen is performed. Then, when it is judged at step S134 that the OK key 204 has been operated, the new data are stored in a specified area of the RAM 46 at step S135, or if a memory card is inserted, the new data are stored in the memory card. Then, rewriting on the whole screen is performed.

Figure 21:
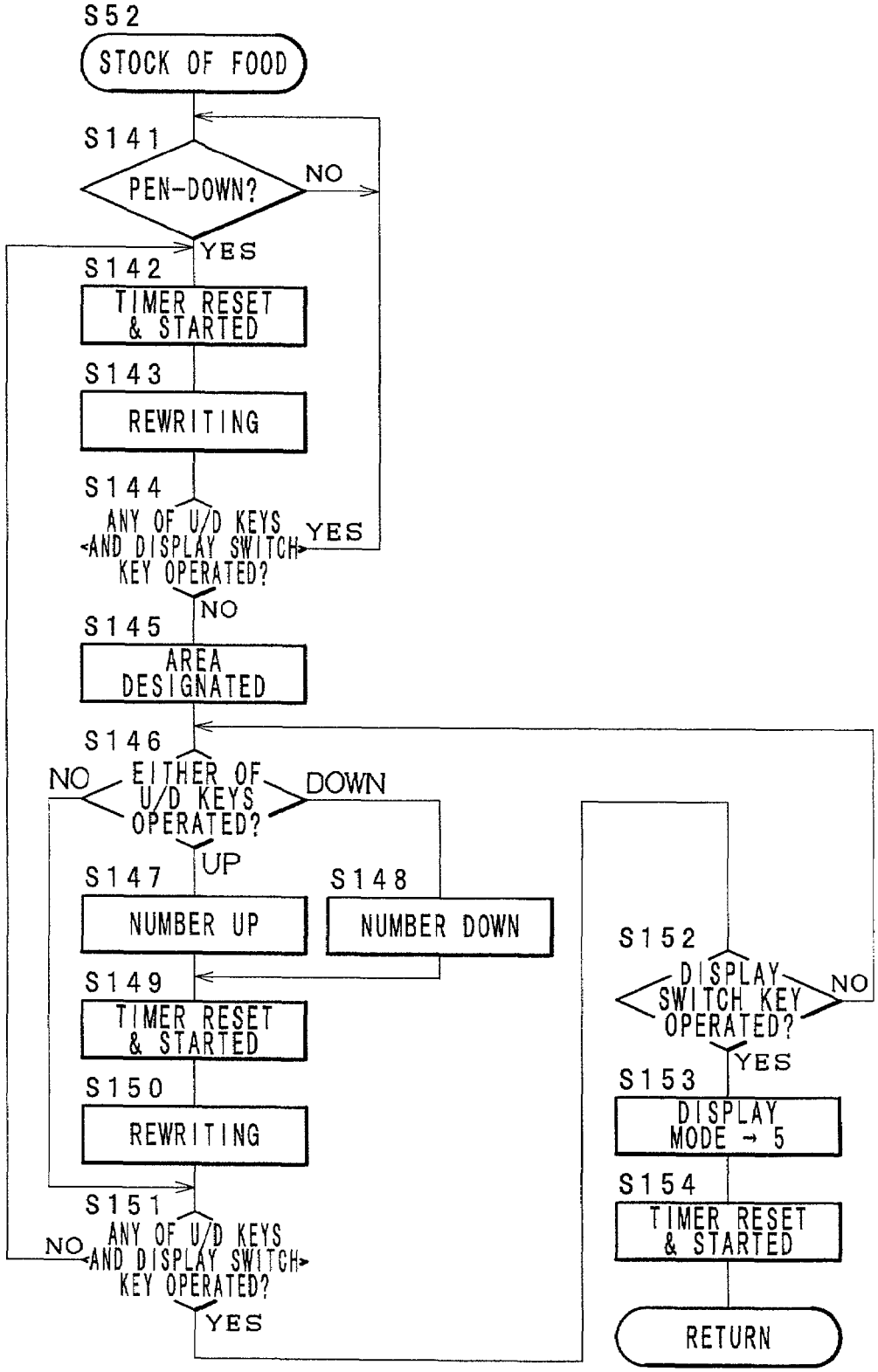
FIG. 21 is a flowchart which shows a food stock displaying subroutine.

FIG. 21 is a food stock displaying subroutine (see FIG. 7) executed at step S52. First at step S141, the CPU 40 waits for a pen-down. When a pen-down is recognized, the energy saving timer is reset and started at step S142, and rewriting on the whole screen is performed at step S143. Next at step S144, the position of the pen-down is checked. If either of the UP/DOWN keys 202, 203 and the switch key 201 has been operated by the pen-down, the program goes back to step S141. If any other area has been operated, at step S145, only the scan lines in the area designated by the pen-down are driven to bold the frame of the area.

Next, it is judged at step S146 whether or not any operation on the UP/DOWN keys 202 and 203 has been made. If the UP key 202 has been operated, the liquid crystal display 100 is partly driven to increase the number in the designated area at step S147. If the DOWN key 203 has been operated, the liquid crystal display 100 is partly driven to decrease the number in the designated area at step S148. In this way, the user can change the value in a designated item. For example, referring to FIG. 7, by designating "the number of carrots" and operating the DOWN key 203, the number is changed to "1".

Then, the energy saving timer is reset and started at step S149, and the same image is written again on the whole screen at step S150. Further, if it is judged at step S151 that a pen-down in any area other than the UP/DOWN keys 202, 203 and the switch key 201 has been made, the program goes back to step S142. If any of the keys 201, 202 and 203 has been operated, it is judged at step S152 whether or not the display switch key 201 has been operated. If not, the program goes back to step S146. If the switch key 201 has been operated, the display mode number is changed to 5 at step S153, and the energy saving timer is reset and started at step S154. Then, this subroutine is completed.

Figure 22:
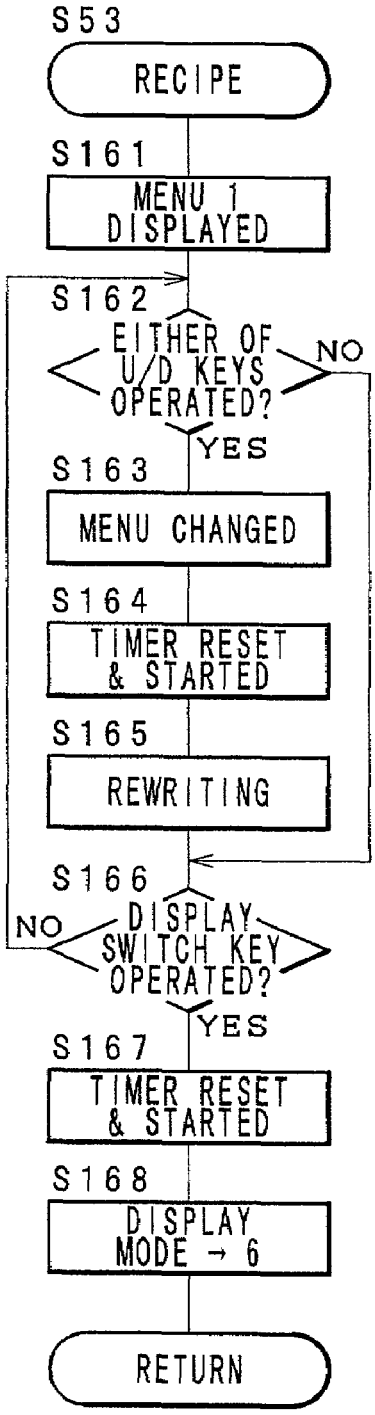
FIG. 22 is a flowchart which shows a recipe displaying subroutine.

FIG. 22 shows a recipe displaying subroutine (see FIG. 8) executed at step S53. First at step S161, a recipe for menu 1 (curry) is displayed, and it is judged at step S162 whether or not any operation on the UP/DOWN keys 202 and 203 has been made. If either the key 202 or the key 203 has been operated, at step S163, another menu which is selected from the memory in accordance with the key operation is displayed. The energy saving timer is reset and started at step S164, and rewriting on the whole screen is performed at step S165.

Next, it is judged at step S166 whether or not the display switch key 201 has been operated, and if not, the program goes back to step S162. If the key 201 has been operated, the energy saving timer is reset and started at step S167, and the display mode number is changed to 6 at step S168. Then, this subroutine is completed.

Figure 23:
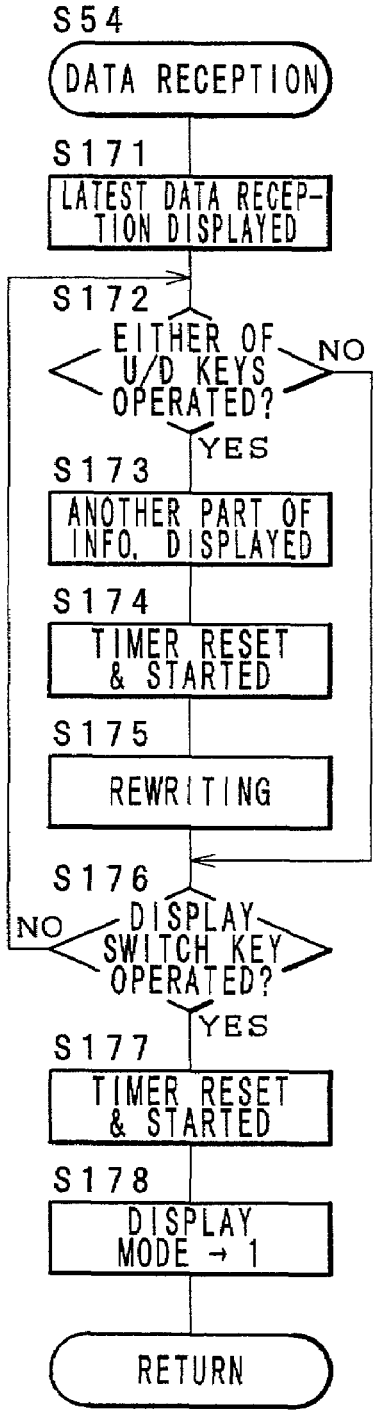
FIG. 23 is a flowchart which shows a data reception displaying subroutine.

FIG. 23 shows a data reception displaying subroutine executed at step S54. First at step S171, the latest information about data reception is displayed, and it is judged at step S172 whether or not any operation on the UP/DOWN keys 202 and 203 has been made. If either the key 202 or the key 203 has been operated, another piece of information in accordance with the key operation is displayed at step S173. The energy saving timer is reset and started at step S174, and rewriting on the whole screen is performed at step S175.

Next, it is judged at step S176 whether or not the display switch key 201 has been operated. If not, the program goes back to step S172. If the key 201 has been operated, the energy saving timer is reset and started at step S177, and the display mode number is changed to 1 at step S178. Then, this subroutine is completed.

Liquid Crystal Display and Touch Panel

The liquid crystal display 100, which has liquid crystal which exhibits a cholesteric phase, and the touch panel 140 which are employed in the display device 10 are described.

Structure

Figure 24:
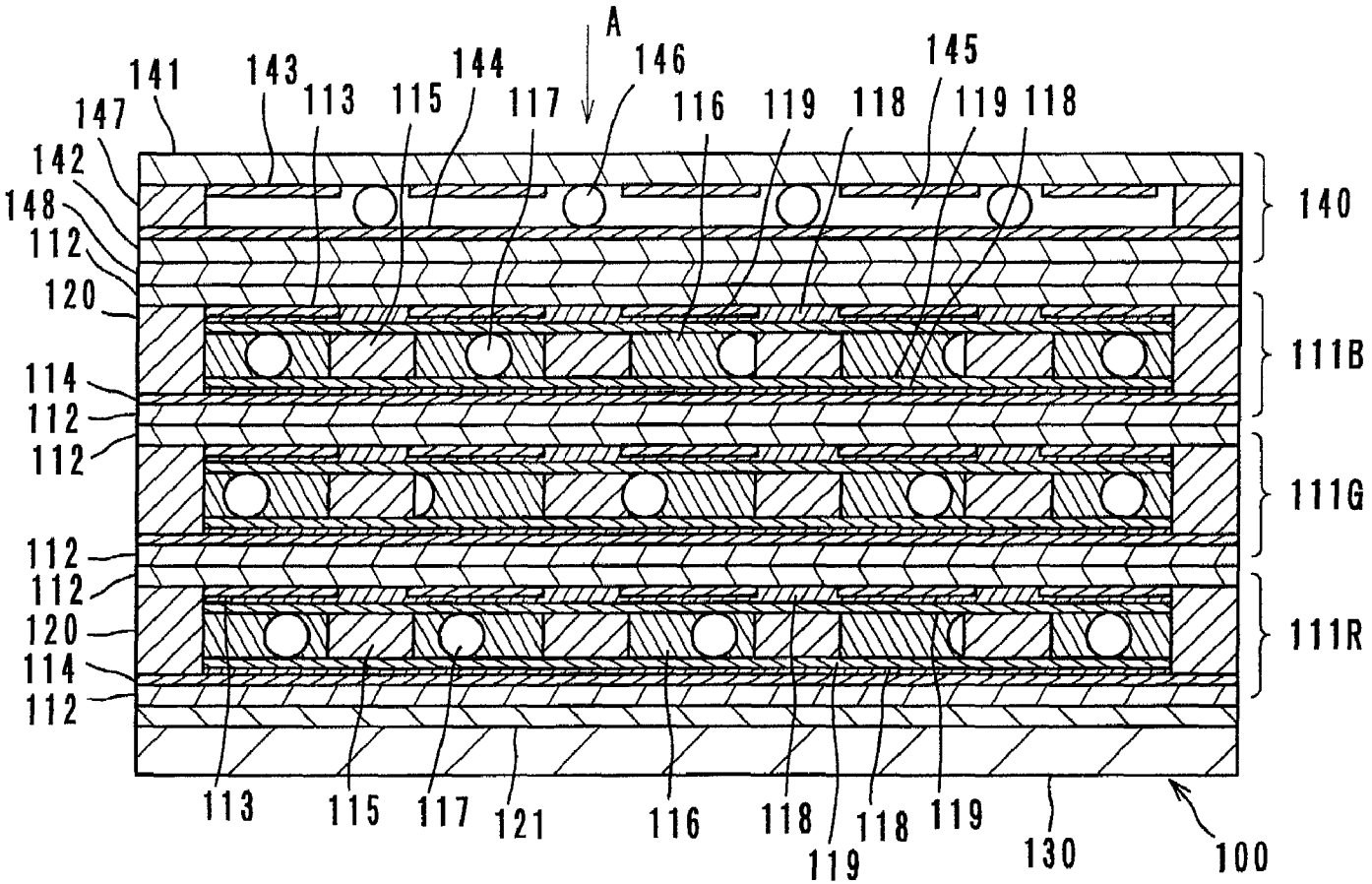
FIG. 24 is a sectional view of an exemplary liquid crystal display used as the display of the display device.

FIG. 24 shows an exemplary reflective type liquid crystal display. This liquid crystal display 100 has a light absorber 121 on a support 130 of a rigid material which is to prevent a bend. On the light absorber 121, a red display layer 111R which makes a display by switching between a red selective reflection state and a transparent state is provided. On the red display layer 111R, a green display layer 111G which makes a display by switching a green selective reflection state and a transparent state is provided, and on the layer 111G, a blue display layer 111B which makes a display by switching a blue selective reflection state and a transparent state is provided.

The touch panel 140 is provided on the liquid crystal display 100 with a protective layer 148 made of a rigid material in-between. The protective layer 148 is to prevent pressure from being applied to part of the liquid crystal display 100. This touch panel 140 is of a conventional structure. On the respective surfaces of transparent substrates 141 and 142 which face each other, electrodes 143 and 144 are so arranged as to form a matrix type sensor. The substrates 141 and 142 are kept to have a specified gap in-between by spherical spacers 146 provided between the substrates 141 and 142 and a sealant 147 provided in the periphery, and an air layer 145 is sealed therein. The intersections of the electrodes 145 and the electrodes 144 are sensing sections, and these sensing sections are for the respective pixels of the color display layers 111R, 111G and 111B, which will be described later.

Each of the display layers 111R, 111G and 111B has a resin columnar structure 115, liquid crystal 116 and spacers 117 between transparent substrates 112 which have transparent electrodes 113 and 114, respectively, thereon. On the transparent electrodes 113 and 114, insulating layers 118 and/or alignment controlling layers 119 are provided if necessary. Further, a sealant 120 is provided on the periphery (outside the display area) of the substrates 112 to seal the liquid crystal 116 therein.

The transparent electrodes 113 and 114 are connected to the driving IC 53 (131, 132) (see FIGS. 5, 6 and 27), and specified pulse voltages are applied to the transparent electrodes 113 and 114. In response to the application of the voltages, the liquid crystal 116 switches between a transparent state to transmit visible light and a selective reflection state to selectively reflect visible light of a specified wavelength, thereby switching a display.

The transparent electrodes 113 and 114 of each display layer are in the form of strips arranged in parallel at fine uniform intervals. The electrode strips 113 face the electrode strips 114, and the extending direction of the electrode strips 113 and the extending direction of the electrode strips 114 are perpendicular to each other. Electric power is applied to the upper electrode strips and lower electrode strips in order. In other words, to the liquid crystal 116 in each display layer, a voltage is applied in a matrix, so that the liquid crystal 116 makes a display. This is referred to as a matrix drive. By performing this matrix drive toward the display layers sequentially or simultaneously, the liquid crystal display 100 displays a full-color image.

A liquid crystal display which has liquid crystal which exhibits a cholesteric phase between two substrates makes a display by switching the liquid crystal between a planar state and a focal-conic state. In the planar state, the liquid crystal selectively reflects light of a wavelength $\lambda=Pn$ (P: helical pitch of the cholesteric liquid crystal, n: average refractive index of the liquid crystal). In the focal-conic state, if the wavelength of light selectively reflected by the cholesteric liquid crystal is in the infrared spectrum, the liquid crystal scatters light, and if the wavelength of light selectively reflected is shorter than the infrared spectrum, the liquid crystal transmits visible light. Therefore, by setting the wavelength of light selectively reflected by the liquid crystal within the visible spectrum and providing a light absorbing layer on the side of the display opposite the observing side, the liquid crystal, in the planar state, makes a display of a color corresponding to the wavelength of light selectively reflected and in the focal-conic state, makes a black display. Also, by setting the wavelength of light selectively reflected by the liquid crystal within the infrared spectrum and providing a light absorbing layer on the side of the display opposite the observing side, the liquid crystal, in the planar state, reflects infrared light and transmits visible light, thereby making a black display, and in the focal-conic state, scatters light, thereby making a white display.

Full-Color Display

The liquid crystal display 100 which has the color display layers 111R, 111G and 111B makes a red display by setting the liquid crystal 116 of the blue display layer 111B and the green display layer 111G to the focal-conic (transparent) state and setting the liquid crystal 116 of the red display layer 111R to the planar (selective reflection) state. The liquid crystal display makes a yellow display by setting the liquid crystal 116 of the blue display layer 111B to the focal-conic (transparent) state and setting the liquid crystal 116 of the green display layer 111G and the red display layer 111R to a planar (selective reflection) state. By setting the liquid crystal 116 of the respective color display layers to the transparent state or to the selective reflection state, displays of red, green, blue, white, cyan, magenta, yellow and black are possible. Also, by setting the liquid crystal 116 of the respective color display layers to the intermediate state, displays of intermediate colors are possible. Thus, the liquid crystal display 100 can be used as a full-color display.

The laminating order of the color display layers 111R, 111G and 111B in the liquid crystal display 100 is not limited to the order shown by FIG. 23, and other orders are possible. However, considering that light in a longer wavelength range is easier to be transmitted than light in a shorter wavelength, it is good to arrange the layer which selectively reflects light of a shorter wavelength in an upper position than the layer which selectively reflects light of a longer wavelength. With this arrangement, more light passes downward, and a brighter display becomes possible. Accordingly, it is the best for good display performance to arrange the blue display layer 111B, the green display layer 111G and the red display layer 111R in this order viewing from the observing direction (indicated by arrow "A").

Materials for the Display

As the transparent substrates 112, transparent glass plates and transparent resin films can be used. As the transparent resin films, polycarbonate resin, polyether sulfone resin, polyethylene terephthalate resin, norbornene resin, polyalylate resin, amorphous polyorefine resin, modified acrylate resin, etc. can be named. Such resin films used as the transparent substrates 112 are required to have the following characteristics: high light transmittance, optical non-anisotropy, dimensional stability, surface smoothness, antifriction, elasticity, high electric insulation, chemical resistance, liquid crystal resistance, heat resistance, moisture resistance, a gas barrier function, etc. One from these materials is selected depending on the circumstances where the liquid crystal display 100 is to be used and the usage.

As the transparent electrodes 113 and 114, transparent electrode materials such as ITO (Indium Tin Oxide), metal such as aluminum, silicon, etc. and photoconductive films such as amorphous silicon, BSO (bismuth silicon oxide), etc. are usable. The lowermost electrodes 114 may be black so as to also function as a light absorber.

As the insulating layers 118, inorganic films such as silicon oxide, etc. and organic films such as polyimide resin, epoxy resin, etc. are usable so as to also function as gas barrier layers. The insulating layers 118 are to prevent short circuits among the substrates 112 and to improve the reliability of the liquid crystal. As the alignment controlling layers 119, typically, polyimide is used.

Preferably, the liquid crystal 116 exhibits a cholesteric phase in a room temperature. Especially, chiral nematic liquid crystal which is produced by adding a chiral agent to nematic liquid crystal is suited.

A chiral agent is an additive which twists molecules of nematic liquid crystal. When a chiral agent is added to nematic liquid crystal, the liquid crystal molecules form a helical structure with uniform twist intervals, whereby the nematic liquid crystal exhibits a cholesteric phase.

By changing the content of the chiral agent in chiral nematic liquid crystal, the pitch of the helical structure can be changed. In this way, the wavelength of light to be selectively reflected by the liquid crystal can be controlled. Generally, the pitch of the helical structure is expressed by a term "helical pitch" which is defined as the distance between molecules which are located at 360° to each other along the helical structure of the liquid crystal molecules.

The columnar structure 115 can be made of, for example, thermoplastic resin. Such thermoplastic resin used for the columnar structure 115 is required to be softened by heat and solidified by cool, not to chemically react to the liquid crystal material used and to have appropriate elasticity.

Specifically, polyvinyl chloride resin, polyvinilidene chloride resin, polyester methacrylate resin, polyacrylic ester resin, polyvinyl acetate resin, polystyrene resin, polyamide resin, polyethylene resin, polypropylene resin, fluororesin, polyurethane resin, polyacrylonitrile resin, polyvinyl ether resin, polyvinyl ketone resin, polyvinyl pyrolidone resin, polycarbonate resin, chlorinated polyether resin, saturated polyester resin, etc. can be used.

One or more of these materials may be used by itself or by mixture. Also, a mixture which at least contains one or more of these materials may be used.

Figure 25:
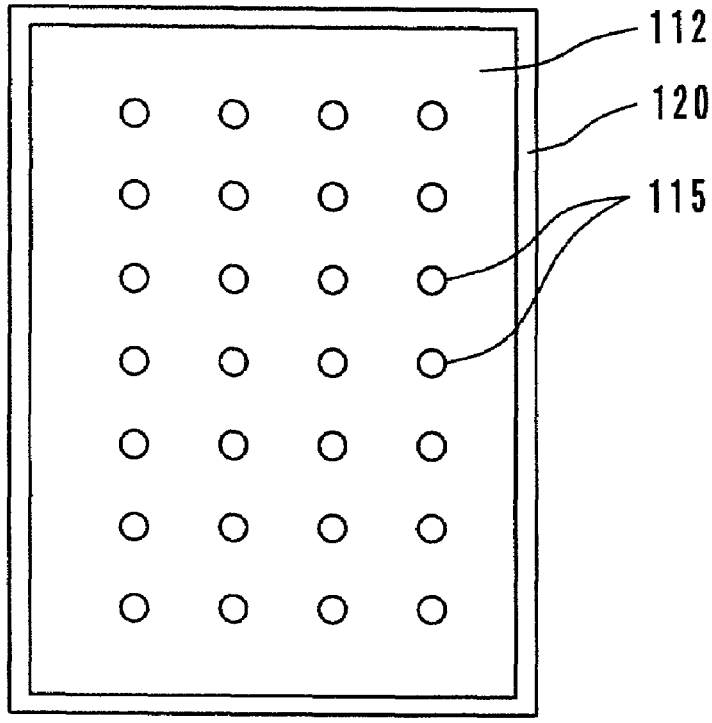
FIG. 25 is a plan view of the liquid crystal display, showing a state wherein a columnar structure and a sealant are formed on a substrate.

As FIG. 25 shows, such a material is printed into a pattern of dotted columns by a conventional printing method. The size, the arrangement pitch, the shape (cylinder, drum, square pole, etc.) of the columns are determined depending on the size and the image resolution of the liquid crystal display. If the columns are arranged among the electrode strips 113, the actual display area will be large, which is preferable.

The spacers 117 are preferably particles of a rigid material which are hardly deformed by heat and/or pressure. For example, inorganic materials such as fine glass fiber, balls of silicate glass, aluminum powder, etc. and organic synthetic particles such as divinylbenzene bridged polymer, polystyrene bridged polymer, etc. are usable.

Thus, between two substrates 112, the spacers 117 of a rigid material are provided to keep the gap even, and the resin columnar structure 115 made of mainly thermoplastic polymer is provided to support and bond the two substrates in such a way that the columns are arranged in a specified pattern within the display area. Thereby, the substrates 112 are wholly supported firmly, and alignment unevenness of the liquid crystal and an occurrence of bubbles under a low temperature can be prevented.

Exemplary Producing Method of Liquid Crystal Display

Now, an exemplary producing method of the liquid crystal display 100 is briefly described.

First, on two transparent substrates, a plurality of strip-like transparent electrodes are formed. Specifically, on each of the substrates, an ITO film is formed by a sputtering method or the like, and thereafter, the ITO films is patterned by photolithography.

Next, insulating layers and alignment controlling layers are formed on the respective sides of the substrates with the electrodes thereon. The insulating layers and the alignment controlling layers are formed of an inorganic material such as silicon oxide or an organic material such as polyimide resin by a conventional method such as a sputtering method, a spin-coat method, a roll-coat method or the like. Usually, the alignment controlling layers are not subjected to a rubbing treatment. Although the function of an alignment controlling layer is not clear, it seems that an alignment controlling layer enables the liquid crystal to have an anchoring effect and prevents the liquid crystal display from changing its characteristics with aging. A coloring agent may be added to these layers to cause these layers to also function as color filters so that the color purity and the contrast can be improved.

On one of the substrates which have obtained the transparent electrodes, the insulating layers and the alignment controlling layers in this way, a resin columnar structure is formed on the side with the electrodes thereon. For formation of the resin columnar structure, resin paste which is produced by dissolving resin in a solvent is used. The columnar structure may be formed by a printing method wherein the resin paste is extruded from a squeegee via a screen or a metal mask and printed on the substrates placed on a flat plate, by a dispenser method or an ink jet method wherein the resin paste is discharged from the end of a nozzle onto the substrate, or by a transfer method wherein the resin paste is supplied onto a plate or a roller and thereafter transferred onto the substrate. Preferably, when the resin columnar structure is formed, the thickness is larger than the desired thickness of the liquid crystal layer.

On the side of the other substrate with the electrodes thereon, a sealant made of ultraviolet ray setting resin, thermosetting resin or the like is provided. The sealant is made into a ring along the periphery of the substrate. The sealant can be formed by a dispenser method or an ink jet method wherein resin is discharged from the end of a nozzle onto the substrate, by a printing method wherein resin is printed on the substrates via a screen, a metal mask or the like, or by a transfer method wherein resin is supplied on a plate or a roller and thereafter transferred onto the substrate. Further, on at least one of the substrates, spacers are dispersed by a conventional method.

Figure 26:
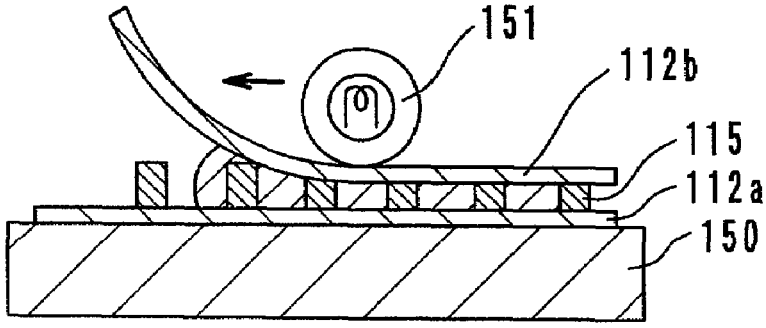
FIG. 26 is an illustration which shows a manufacturing process of the liquid crystal display.

These substrates are laminated with the respective electrode sides facing each other, and the laminate of substrates is heated while being pressed from both sides. The pressing/heating process can be performed, for example, in the way shown by FIG. 26. The substrate 112*a* with the resin columnar structure 115 formed thereon is placed on a flat plate 150, and the other substrate 112*b* is placed on the substrate 112*a*. At this time, the laminate of substrates is heated and pressed by a heating/pressing roller 151 from an end while passing between the roller 151 and the plate 150. By adopting this method, even if the substrates are flexible, for example, film substrates, a cell can be fabricated accurately. If the columnar structure is made of thermoplastic polymer, the columnar structure is softened by heat and hardened by cool, whereby the substrates are bonded by the resin columnar structure. If the sealant is made of thermosetting resin, the sealant is hardened by the heat for the lamination of the substrates.

In this laminating process, further, a liquid crystal material is dropped at an end of one of the substrates, and the liquid crystal material is spread out between the substrates while the substrates are being laminated. In this case, spacers are contained in the liquid crystal material beforehand, and this liquid crystal material is dropped on the electrode side of one of the substrates.

By dropping a liquid crystal material on an end of a substrate and by spreading out the liquid crystal between two substrates while laminating the substrates, the liquid crystal can be filled entirely in the substrates. In this method, bubbles which have occurred at the time of lamination are hardly taken in.

The application of pressure to the laminate of substrates is continued at least until the temperature of the substrates is dropped to a temperature lower than the softening point of the resin material of the columnar structure. If the sealant is photosetting resin, after the laminate of substrates is relieved from the pressure, light is radiated to harden the resin.

Using liquid crystal materials which selectively reflect light of mutually different wavelengths, cells for blue display, for green display and for red display are fabricated. These cells are laminated in three layers and are joined by an adhesive, and further, a light absorbing layer is provided on the bottom. Thus, a full-color liquid crystal display is produced.

Control Circuit and Driving Method of Liquid Crystal Display

Figure 27:
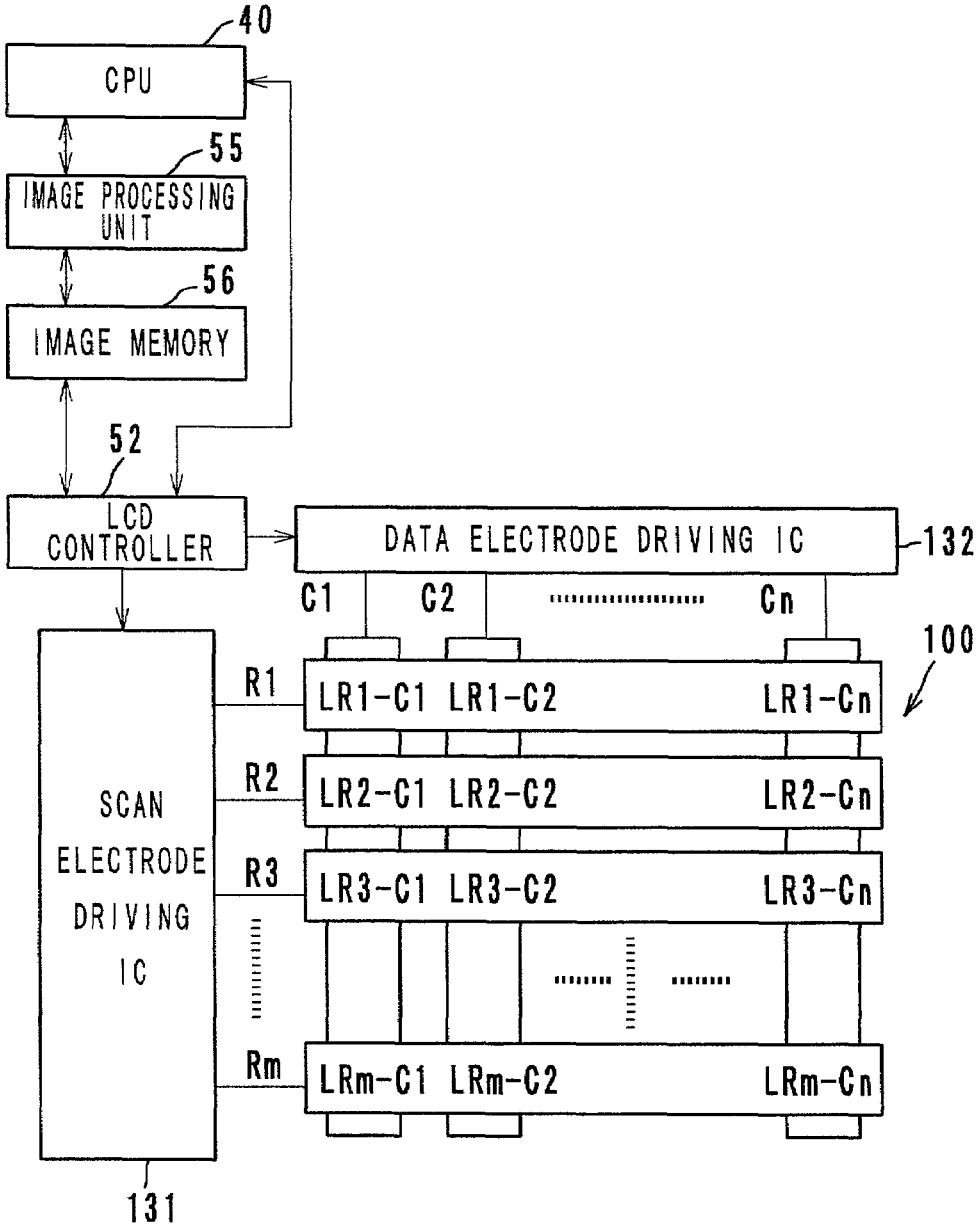
FIG. 27 is a block diagram which shows a matrix driving circuit of the liquid crystal display.

As FIG. 27 shows, the pixels of the liquid crystal display 100 are structured in a matrix composed of a plurality of scan electrodes R1, R2 through Rm and a plurality of data electrodes C1, C2 through Cn (m, n: natural numbers). The scan electrodes R1, R2 through Rm are connected to output terminals of a scan electrode driving IC 131, and the data electrodes C1, C2 through Cn are connected to output terminals of the data electrode driving IC 132.

The scan electrode driving IC 131 outputs a selective signal to a specified one of the scan electrodes R1 through Rm so as to set the specified scan electrode to a selected state while outputting a nonselective signal to the other scan electrodes so as to set the scan electrodes to a non-selected state. The scan electrode driving circuit 131 outputs the selective signal to the scan electrodes R1 through Rm in order while switching at regular intervals. In the meantime, the data electrode driving circuit 132 outputs a signal in accordance with image data to the data electrodes C1 through Cn for writing on the pixels on the scan electrode in a selected state. For example, when a scan electrode Ra (a: natural number, $a \leqq m$) is selected, writing is performed on the pixels Lra-C1 through Lra-Cn at the intersections of the scan electrodes Ra and the data electrodes C1 through Cn. Thus, in each pixel, the difference between the voltage applied to the scan electrode and the voltage applied to the data electrode is a writing voltage, and each pixel is written by this writing voltage.

A driving circuit is composed of the CPU 40, the LCD controller 52, the image processing unit 55, the image memory 56 and the driving ICs 131 and 132. In accordance with image data stored in the image memory 56, the LCD controller 52 controls the driving ICs 131 and 132 to apply electrodes to the scan electrodes and the data electrodes. Thus, an image is written on the liquid crystal display 100.

By applying a voltage of a first threshold value Vth1 which is the threshold voltage to untwist the cholesteric liquid crystal for a sufficient time and thereafter dropping the voltage lower than a second threshold value Vth2 which is smaller than Vth1, the liquid crystal comes to a planar state. Also, by applying a voltage higher than Vth2 and lower than Vth1 to the liquid crystal for a sufficient time, the liquid crystal comes to a focal-conic state. These states can be maintained even after application of a voltage. By applying an intermediate voltage between Vth1 and Vth2, intermediate tones can be displayed.

In writing on part of the liquid crystal display 100, only the scan lines (scan electrodes) which run through the part to be subjected to writing are selected in order. Thus, it is possible to write on only necessary part for a short time.

Writing on each pixel can be done in this way. If an image is already displayed, in order to eliminate the influence of this image, preferably, all the pixels are reset to the same state before writing. The reset of all the pixels may be performed simultaneously or may be performed by scan electrode. It is known that in resetting a pixel to a focal-conic state, it takes a relatively long time until the pixel comes to a sufficient transparent state. Accordingly, it is better to reset all the pixels simultaneously before writing than to reset all the pixels by scan electrode because it takes a shorter time.

Before writing on part of the liquid crystal display 100, the pixels on the scan electrodes which run through the part may be reset by scan electrode or may be reset simultaneously.

In either case, when the CPU 40 issues a writing command, the booster circuit 51 is turned on to apply a raised voltage to the driving ICs 131 and 132, and the LCD controller 52 controls the driving ICs 131 and 132 to write an image on the liquid crystal display 100. Immediately after writing, at least the booster circuit 51 is turned off to reduce the consumption of electric power, and further the supply of electric power to the LCD controller 52 may be turned off to stop the supply of electric power to the driving ICs 131 and 132.

Other Liquid Crystal Displays

The liquid crystal display 100 has a resin columnar structure within the display area. This structure has various advantages of being structured as a large-screen display easily, of requiring a relatively small driving voltage, of being strong against shock, etc. However, a liquid crystal display with a memory effect is not limited to be of this structure. The liquid crystal display layer may be structured as a well-known polymer dispersed type wherein liquid crystal is dispersed in a polymeric three-dimensional net structure or wherein a polymeric three-dimensional net structure is formed in liquid crystal. Although bistable liquid crystal which exhibits a cholesteric phase has been described as liquid crystal with a memory effect, ferrodielectric liquid crystal can be used.

Although the present invention has been described in connection with the preferred embodiments above, it is to be noted that various changes and modifications are possible to those who are skilled in the art. Such changes and modifications are to be understood as being within the scope of the present invention.

What is claimed is:

1. A liquid crystal display device, comprising a display section comprising a plurality of stacked layers, each of said layers comprising a first substrate which is a flexible substrate through which a viewer may view currently displayed information, a second substrate, and a liquid crystal material having a memory effect disposed between the first substrate and the second substrate, the plurality of layers being stacked such that the first substrate in a layer is positioned closer to a viewer side than the second substrate of the layer, the display section being capable of continuing to display information thereon for about one day without applying a voltage thereto and without refreshing the information displayed thereon;

a driving section which drives the display section;

a control section which controls the driving section to write currently displayed information on the display section again at a specified time; and a timer for detecting time elapsing, the time beginning counting when information displayed on the display section is updated;

wherein the control section causes the driving section to rewrite currently displayed information on the display section upon the timer counting to a predetermined value corresponding to a predetermined period of time.

2. A liquid crystal display device according to claim 1, wherein in order to prevent the information displayed on the display section from being degraded by pressure applied to the display section, the information is rewritten on the display section.

3. A liquid crystal display according to claim 1, wherein:

the display section further comprises a touch panel; and in order to prevent the information displayed on the display section from being degraded by pressure applied to the display section, the information is rewritten on the display section.

4. A liquid crystal display device comprising:

a display section comprising chiral nematic liquid crystal which exhibits a cholesteric phase and which has a memory effect sufficient to keep information displayed for at least a day without application of a voltage thereto and without a refresh drive;

a driving section which drives the display section;

an electric power source;

a booster circuit which raises a voltage supplied from the power source and applies the raised voltage to the driving section;

a control section which controls the driving section to write currently displayed information on the display section again at a specified time; and a timer for detecting time elapsing, the timer beginning counting when information displayed on the display section is updated;

wherein:

the control section causes the driving section to rewrite currently displayed information on the display section upon the timer counting to a predetermined value corresponding to a predetermined period of time;

the control section stops supply of electric power to the driving section by inactivating the booster circuit; and the display section is reset by applying a pulse voltage to untwist the chiral nematic liquid crystal to each pixel.

5. A liquid crystal display device according to claim 4, wherein:

the display section has a detecting section which detects a contact action with a screen of the display section; and the control section controls the driving section to write currently displayed information on the display section again when a contact action is detected by the detecting section.

6. A liquid crystal display device according to claim 5, wherein the detecting section is a touch sensor.

7. A liquid crystal display device according to claim 4, wherein the control section controls the driving section to perform writing on part of the display section and thereafter to write currently displayed information on the display section again.

8. A liquid crystal display device according to claim 4, further comprising a terminal through which electricity is charged in a battery from an external device.

9. A liquid crystal display device according to claim 8, wherein the external device is a refrigerator.

10. A liquid crystal display device according to claim 4, which is attachable to and detachable from an external device.

11. A liquid crystal display device according to claim 10, wherein the external device is a refrigerator.

12. A liquid crystal display device according to claim 4, wherein the information is about at least one of a calendar, a recipe, a message, stock, a picture and data reception from outside.

13. A liquid crystal display device according to claim 4, wherein the display section is reset by causing each pixel to come to a focal-conic state.

14. A liquid crystal display device according to claim 4, further comprising an operating member for permitting a user to input a rewrite command to command the display section to rewrite currently displayed information on the display section.

15. A liquid crystal display device according to claim 14, wherein the manual operating member is a member for an exclusive purpose of inputting a rewrite command to command rewriting currently displayed information on the display section.

16. A liquid crystal display device according to claim 4, wherein:

the display section comprises a flexible substrate; and in order to prevent the information displayed on the display section from being degraded by pressure applied to the display section, the information is rewritten on the display section.

17. A liquid crystal display device according to claim 4, wherein:

the display section comprises a touch panel; and in order to prevent the information displayed on the display section from being degraded by pressure applied to the display section, the information is rewritten on the display section.

18. A liquid crystal display device according to claim 4, wherein all the pixels in an area of the display section to be subjected to writing are reset simultaneously.

19. A liquid crystal display device according to claim 18, wherein the pixels in an area of the display section to be subjected to writing are reset line by line.

20. A display device comprising:

a display section which has a memory effect sufficient to keep information displayed for at least a day without application of a voltage thereto and without a refresh drive;

a driving section which drives the display section;

an electric power source;

a booster circuit which raises a voltage supplied from the power source and applies the raised voltage to the driving section;

a control section which controls the driving section to write an image on the display section based on an image information; and a timer for detecting time elapsing, the timer beginning counting when writing of an image on the display section is completed;

wherein:

the control section causes the driving section to rewrite currently displayed information on the display section upon the timer counting to a predetermined value corresponding to a predetermined period of time;

the control section stops supply of electric power to the driving section by inactivating the booster circuit after writing of an image on the display section; and the display section is reset by applying a pulse voltage to each pixel before rewriting of currently displayed information on the display section.

* * * * *

UNITED STATES PATENT AND TRADEMARK OFFICE

CERTIFICATE OF CORRECTION

PATENT NO. : 7,126,569 B2
APPLICATION NO. : 09/527368
DATED : October 24, 2006
INVENTOR(S) : Hiroshi Ootsuka et al.

It is certified that error appears in the above-identified patent and that said Letters Patent is hereby corrected as shown below:

Cover Page (54) Title:

After "DEVICE", insert --WITH A MEMORY EFFECT--.

Signed and Sealed this

Twenty-third Day of January, 2007

JON W. DUDAS
*Director of the United States Patent and Trademark Office*